US010295315B2

(12) United States Patent
Harris et al.

(10) Patent No.: US 10,295,315 B2
(45) Date of Patent: May 21, 2019

(54) TARGET SYSTEM

(71) Applicant: TS Founders, LLC, St. Louis, MO (US)

(72) Inventors: Kenneth William Harris, St. Louis, MO (US); Justin Taylor Snell, St. Louis, MO (US); Brandon Thomas Hefer, St. Louis, MO (US); Aaron Paul Brookhart, St. Louis, MO (US)

(73) Assignee: Triumph Systems, Inc., St. Louis, MO (US)

( * ) Notice: Subject to any disclaimer, the term of this patent is extended or adjusted under 35 U.S.C. 154(b) by 0 days.

(21) Appl. No.: 15/723,026

(22) Filed: Oct. 2, 2017

(65) Prior Publication Data

US 2018/0045495 A1 Feb. 15, 2018

Related U.S. Application Data

(63) Continuation-in-part of application No. 14/808,748, filed on Jul. 24, 2015, now Pat. No. 9,927,215.

(60) Provisional application No. 62/404,639, filed on Oct. 5, 2016.

(51) Int. Cl.

| | |
|---|---|
| ***F41J 7/06*** | (2006.01) |
| ***F41J 7/00*** | (2006.01) |
| ***F41J 9/00*** | (2006.01) |
| ***F41J 1/10*** | (2006.01) |

(52) U.S. Cl.

CPC . *F41J 7/06* (2013.01); *F41J 1/10* (2013.01); *F41J 7/00* (2013.01); *F41J 9/00* (2013.01)

(58) Field of Classification Search

CPC .. F41J 9/02; F41J 9/00; F41J 1/10; F41J 7/00

See application file for complete search history.

(56) References Cited

U.S. PATENT DOCUMENTS

| | | | |
|---|---|---|---|
| 2,899,204 | A | 8/1959 | Ratay |
| 3,319,960 | A | 5/1967 | Wilcox |
| 3,914,879 | A | 10/1975 | Taylor, III et al. |
| 4,288,080 | A | 9/1981 | Laporte et al. |
| 4,501,427 | A | 2/1985 | Payne |
| 5,163,689 | A | 11/1992 | Bateman |
| 5,350,180 | A | 9/1994 | Acock |
| 5,577,734 | A | 11/1996 | Conroy |
| 6,491,303 | B1 | 12/2002 | Huston |
| 7,303,192 | B2 | 12/2007 | Marshall et al. |
| 7,900,927 | B1 | 3/2011 | Bliehall |
| 7,950,667 | B2 | 5/2011 | Shum |
| 8,444,150 | B1 | 5/2013 | Stirtz |
| 8,720,896 | B2 | 5/2014 | Matthis |
| 9,157,706 | B2 | 10/2015 | Shea |
| 9,267,769 | B1 | 2/2016 | Gempler |
| 2006/0290064 | A1 | 12/2006 | Hagar |
| 2008/0088089 | A1 | 4/2008 | Bliehall et al. |
| 2011/0298181 | A1 | 12/2011 | Wright et al. |

(Continued)

*Primary Examiner* — Alvin A Hunter
*Assistant Examiner* — Christopher A Glenn
(74) *Attorney, Agent, or Firm* — Creativenture Law, LLC; Dennis J M Donahue, III; Kevin C. Staed

(57) ABSTRACT

A target system designed to be stand-alone and modular which includes a target area which is two or more sided and which can be rotated through a large number of different positions and rotations. The system can also include systems for projectile impact recognition. Target rotation is generally accomplished through a target base that is in communication with and configured to receive data input from a remote target controller.

20 Claims, 17 Drawing Sheets

(56) References Cited

U.S. PATENT DOCUMENTS

| | | | |
|---|---|---|---|
| 2012/0218633 | A1 | 8/2012 | Cincotti et al. |
| 2012/0313324 | A1 | 12/2012 | Frickey |
| 2013/0147117 | A1 | 6/2013 | Graham et al. |
| 2013/0147119 | A1 | 6/2013 | Matthis |

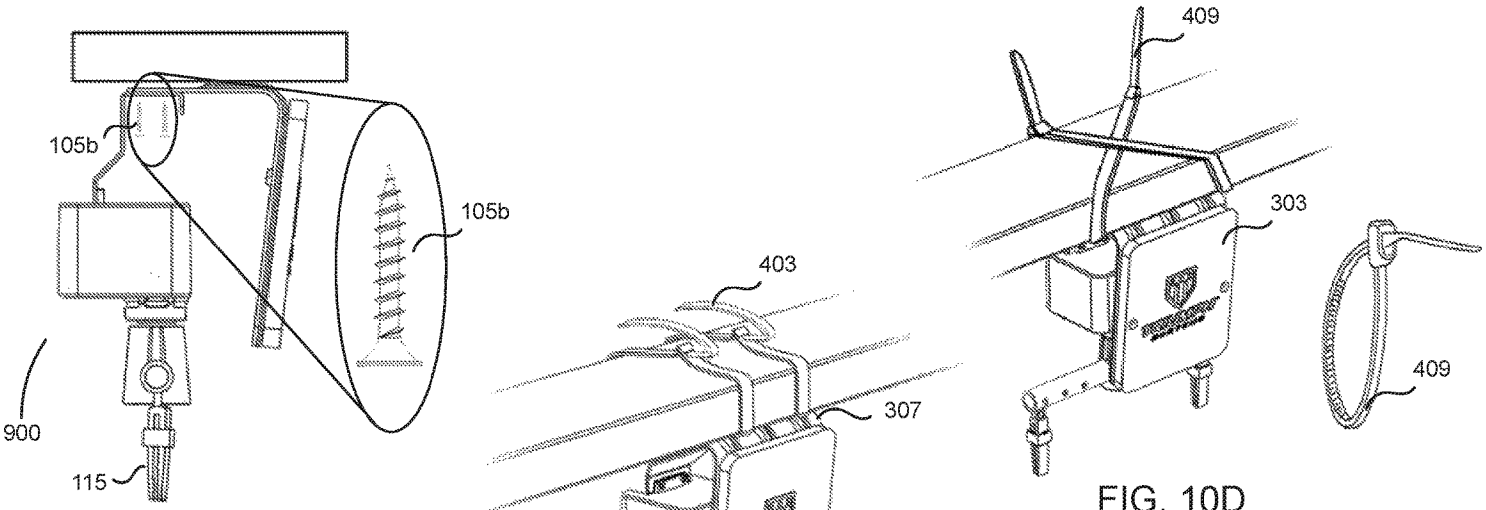
FIG. 10A
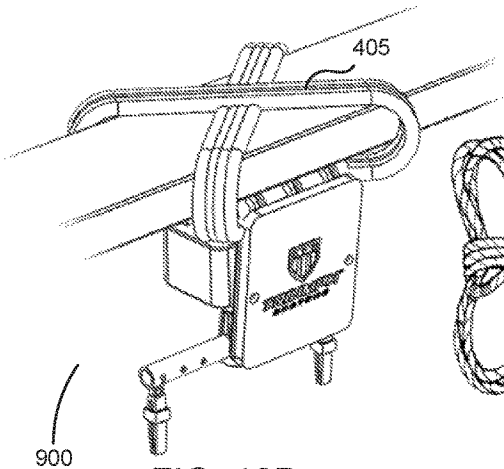
FIG. 10B
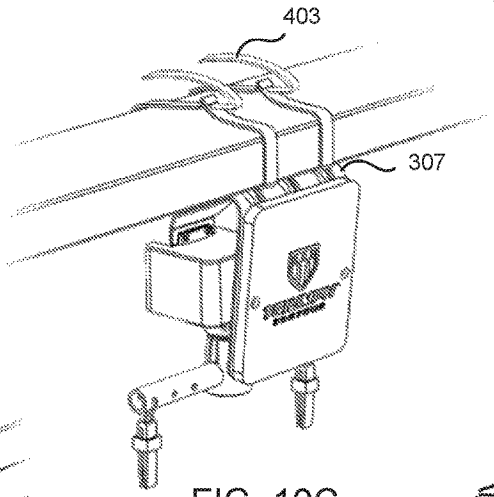
FIG. 10C
FIG. 10D
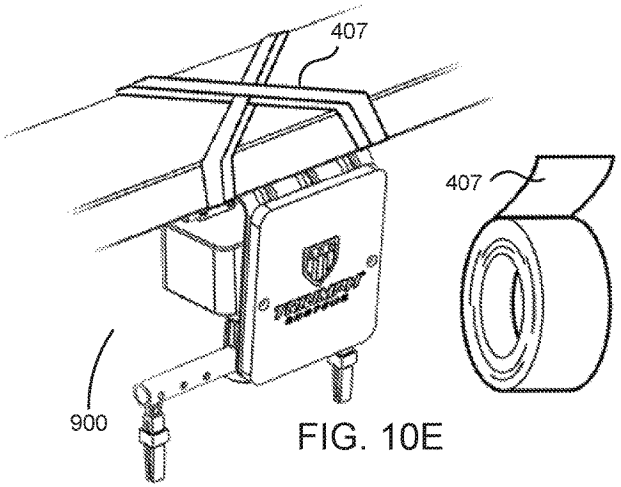
FIG. 10E

TARGET SYSTEM

CROSS-REFERENCE TO RELATED APPLICATIONS

This application claims priority from U.S. Provisional Patent Application No. 62/404,639 filed on Oct. 5, 2016 and is a continuation-in-part of U.S. patent application Ser. No. 14/808,748 filed on Jul. 24, 2015, both of which are hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to a firearm target training device wherein a target is suspended from a rotating motor affixed to a support structure.

Related Art

Target systems are used to improve shooting skills. Target systems are located predominantly on static shooting ranges, but can also be setup in arenas, simulators or "shooting houses" where a specially designed bunker can be used to present structure clearing and securing scenarios. Shooting ranges typically have indoor and outdoor shooting lanes where shooters are provided with a lane and shoot at a target positioned downrange while other shooters do the same in adjacent lanes. Most shooting practice at standard ranges will utilize a paper target attached to a rail mechanism that moves these paper targets from a position downrange to a viewing position close to the shooter.

The user will affix the target to the rail while standing in their shooting position and then activate the rail to carry the target a predetermined distance downrange to a static firing position. During the target shooting session, the shooter aims and fires at the static target. After the shooter expends a desired number of rounds, the shooter can return the target via the same rail and take down the target to see where the target was hit. They can then replace it with another target, if desired, and repeat. This allows each shooter to operate according to their own timing, ammunition expenditure, etc. and replace targets without the need for the shooter to actually go downrange.

Static ranges allow one to improve aiming and dialing in of sights, handling of a firearm of a particular type, and comfort level with a gun's particular behavior (such as the level of recoil for different ammunition types) when it is fired. Further, they traditional rail target system seen in numerous shooting ranges provides a safe and efficient way for multiple shooters to train simultaneously. However, these static shooting targets fail to provide any kind of simulated scenarios that test a shooters reaction time and ability to quickly make decisions. Other scenarios absent from static target systems include self-defense training and concealed carry training for civilians as well as highly dynamic and varying police and military hostage and combat situations. Further, there an inherent enjoyment factor in participating in dynamic shooting scenarios even though they may likely never be encountered. For example, there is an entertainment value to getting to shoot "zombies" with an actual firearm in a simulated fantasy setting.

The problem with current target systems found on and off shooting ranges is that they do not provide the shooter with an interactive and individualized shooting experience. The current target systems are built on platforms that prevent the shooter from engaging in many challenging and exciting shooting exercises where targets move and shooters must make immediate decisions, simulating those made during actual shooting scenarios. Because the targets are generally in fixed position due to the limitations of the transport rail and shooting lane, they are typically limited to simple target practice. The fixed position of the targets prevents the shooter from improving skills for shooting at a moving target as well as improving mental recognition of threats and non-threats. As many forms of shooting skills (including those for, hunting, self-defense, policing, and military activities) involve ultimately training to shoot at a moving target and almost all shooting skills involve a threat/non-threat determination, these target systems limit the effectiveness of training a shooting range can offer.

To try and create additional shooting scenarios for entertainment and training purposes, targets are often positioned inside shooting houses or other simulated buildings. These locations provide for what is essentially a specialized building or location that the shooter can move through where they can be presented with a variety of static and dynamic targets. Targets (which are often still paper but can also be mannequins or the like) may move into or out of cover or sightlines or may be turned to suddenly face a shooter providing a reveal and hide scenario where shooting speed and correct reaction to a particular presentation can be just as important as shooting accuracy.

While these houses can provide for valuable simulations, they often have a similar problem. In order to provide the pneumatic controllers necessary to allow the targets to move or rotate, the targets can only be placed in a limited number of possible locations which are built into the structure. These locations can rapidly be learned by a trainee having gone through the shooting house a couple of times which may give the shooter an unintended edge in the scenario and thereby limit their ability to learn from their performance and to be accurately graded. Further, while some of these systems can also be used to provide some dynamics to a shooting range (for example by providing turning targets), because of the limitations of traditional shooting range infrastructure, movement is still generally constrained and is limited to only a single turn or pop up motion with static characteristics, or a fixed linear motion. As the movements are limited in the amount of turns or pop ups, these systems do not force a shooter to repeatedly make crucial decisions for an unknown period of time.

Another problem with traditional systems is that they are often highly limited in their movement variation. For rotating targets, there are generally only two positions, edge on (or hidden) and face on (or target). While some targets may present targets depicting a "threat" that is intended to be shot and other targets show "non-threat" images that a shooter should not engage (e.g. four targets may simultaneously turn with two being "threats" and two being "non-threats"), once the target has been revealed and the shooter has either shot or not shot, there is no possibility of the target changing and the simulation has concluded. Further, the targets often operate on a hard wired pattern where they rotate or move according to a fixed scenario regardless of the position of the shooter, or anyone else, in the scenario.

Lastly, the known target systems discussed herein are traditionally found within large target ranges or shooting houses and may not be available to the average consumer. Intricate target systems provide a more realistic shooting simulation but are typically too expensive for regular use by most marksmen and are not transportable. Accordingly, it would be beneficial to provide a target system that is affordable, movable and provides a realistic and dynamic shooting scenario. It would be even more beneficial to have improved aspects of these affordable targets that can be incorporated into the intricate target systems to provide marksmen with an even more realistic and beneficial training simulation.

SUMMARY

The following is a summary of the invention which should provide to the reader a basic understanding of some aspects of the invention. This summary is not intended to identify critical components of the invention, nor in any way to delineate the scope of the invention. The sole purpose of this summary is to present in simplified language some aspects of the invention as a prelude to the more detailed description presented below.

Because of these and other problems in the art described herein, among other things, is a target system and methods related to using and manufacturing a target system. The target system is designed to be stand-alone and modular which includes a target area which is two or more sided and which can be rotated through a large number of different positions and rotations. The system can also include systems for projectile impact recognition. Target rotation is generally accomplished through a target base that is in communication with and configured to receive data input from a remote target controller and/or other target bases.

There is described herein, in various embodiments, a target system comprising: a target having at least two images thereon; and a target base station supporting said target and configured to receive data inputs from a target controller; wherein said target controller sends commands to said target base station to rotate said target through a plurality of different positions wherein a first of said plurality of positions presents a first of said at least two images and a second of said plurality of positions presents a second of said at least two images.

There is also described herein a method of presenting a target to a user comprising: providing a target having at least two images thereon; providing a target base station supporting said target; said base station positioning said target in a first position where none of said at least two images is visible to a user; said base station positioning said target in a second position where a first of said at least two images is visible to a user; and said base station positioning said target in a third position where a second of said at least two images is visible to a user; wherein said first position, said second position, and said third position can be provided in any order or pattern.

BRIEF DESCRIPTION OF THE DRAWINGS

The present invention will become more fully understood from the detailed description and the accompanying drawings, wherein:

FIGS. 10A, 10B, 10C, 10D and 10E illustrate alternative fasteners connecting the portable rotating device to the support according to the present invention.

DETAILED DESCRIPTION OF THE PREFERRED EMBODIMENTS

The following description of the preferred embodiment(s) is merely exemplary in nature and is in no way intended to limit the invention, its application, or uses.

Figure 1:
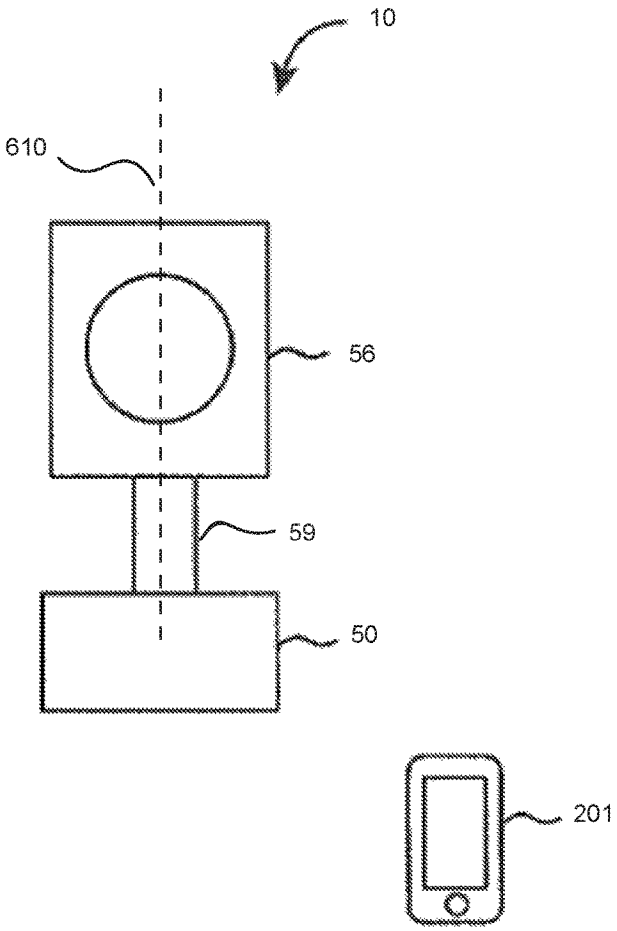
FIG. 1 is a general block diagram of an embodiment of a target system.

FIG. 1 provides a block view of the major components of an embodiment of the target system (10) preferably having a target (56), a target base station (50), and a remote target controller (201). The target (56) in the FIG. 1 embodiment is preferably in mechanical communication (59) with the target base station (50) so the base station (50) can provide it with rotational movement along at least one axis (610). The target base station (50) is preferably in electronic communication with the target controller (201) which can provide the base station (50) with instructions on how to move the target (56). The target (56) in the FIG. 1 embodiment is utilized for projectile impact recognition as well as to present an image indicative to a user of whether or not they should fire on it. As such, it may comprise a paper or similar material target which shows visible penetration when struck by a projectile, it may be a metal structure designed to provide sonic recognition when struck by a projectile, it may comprise a composite or similar material that will stop and hold a projectile to determine impact point, or it may comprise a more sophisticated structure which can otherwise determine that and projectile has impacted the target (56) surface, and where it has impacted it. Generally, the target (50) will provide a "bull's-eye" or similar structure where hitting the target in certain points is considered better than hitting it on others. The target base station (50) is preferably able to withstand projectile impact from a plurality of projectiles including a bullet shot from a firearm but this is not required and the base station (50) may simply be manufactured inexpensively and if hit, may simply be replaced. The target (56) will often be designed for use in a single shooting session and, as such, can be considered disposable.

Figure 2:
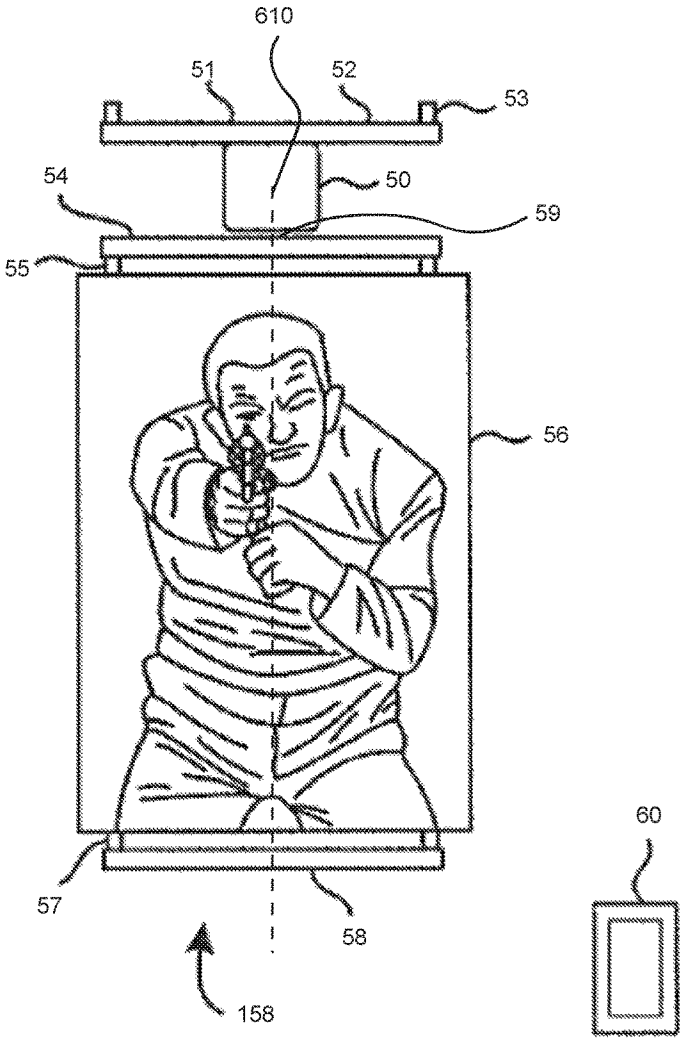
FIG. 2 is a front view of an embodiment of a target system displaying a target in firing position.

In most cases, the target (56) will be comprised of a paper or similar material target (56) which is held in place by a partial or full frame (158) as shown in FIG. 2. The frame (158) has a top bar (54) that has one or more connectors (55) holding the target (56) and that is rotatably secured to the target base station (50) through the connection (59). The frame (158) may also include connectors (57) at the bottom of the target (56) and a bottom bar (58). A target base station (50) is then connected to the frame (158) and the target base station (50) is mounted to a support structure. In the depicted embodiment, the base station (50) is connected to a rod (52) which can be positioned in a traditional indoor or outdoor/shooting range or may be hard mounted into a shooting house or similar dynamic shooting area, or may be part of a traditional rail system. The base station (50) will generally include connector devices (51) in the form of a bracket or similar device which can attach to a variety of objects to provide flexibility of attachment. This can allow the base station (50) to be attached at a variety of locations such as, but not limited to, tree branches (52*a*), fences, (52*b*) wires, door frames (52*c*), or locations within a shooting house or range. It can also allow the base station (50) to simply be attached to a heavy object to support it with the frame (158) held in a generally vertical position. Further, while the embodiment of FIG. 2 depicts that the frame (158) is hanging below the base station (50), this is by no means required and the base station may be positioned below the frame (158) or beside it to provide a perpendicular axis of rotation (610) to that depicted in FIG. 2. It may also be arranged at an angle between the above to provide further options. In a still further embodiment, the rotation could also allow for the target (56) to "pop-up" where it is originally positioned with the top or bottom facing the user (as opposed to a side) in the home position, and the target (56) will rotate upward or downward (instead of side to side) to present an image to the user.

The target base station (50) is preferably a modular unit that can be positioned in a variety of positions. The base station (50) may be used with a plurality of similar base station (50) to provide for a modular or multi-user range, or to provide multiple targets for a single shooter as contemplated below. While it will generally be the case that the base station (50) or support to which it is attached will include a self-leveling device, or level indicator to provide for it to be level to inhibit an uneven amount of torque to be provided to the frame (158), this is not required.

Figure 3:
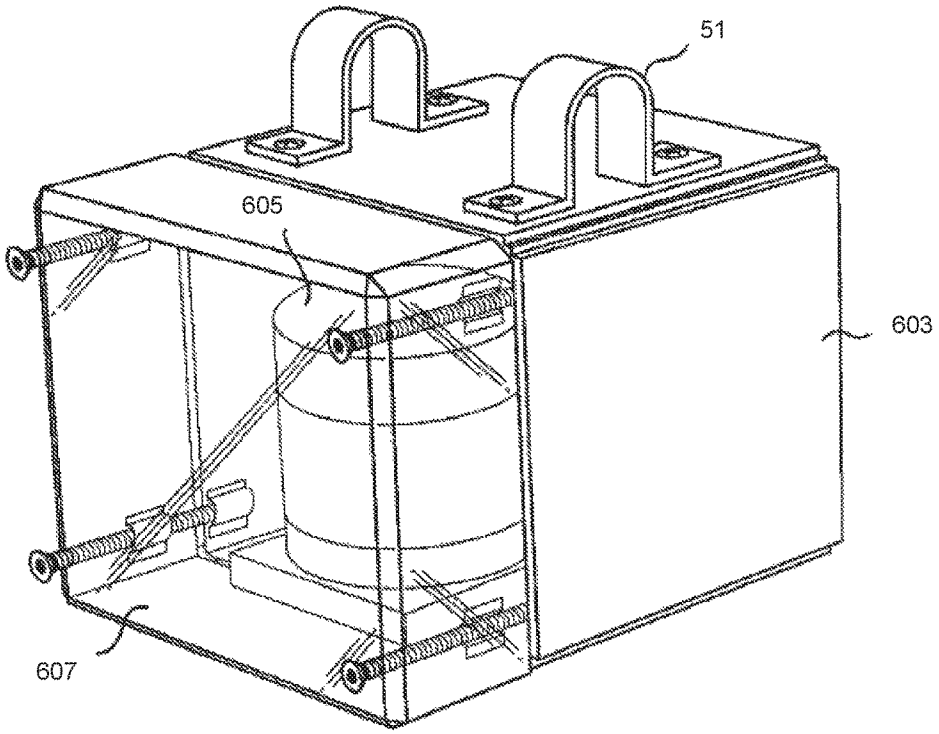
FIG. 3 provides a perspective view of the base station of FIG. 2
Figure 4:
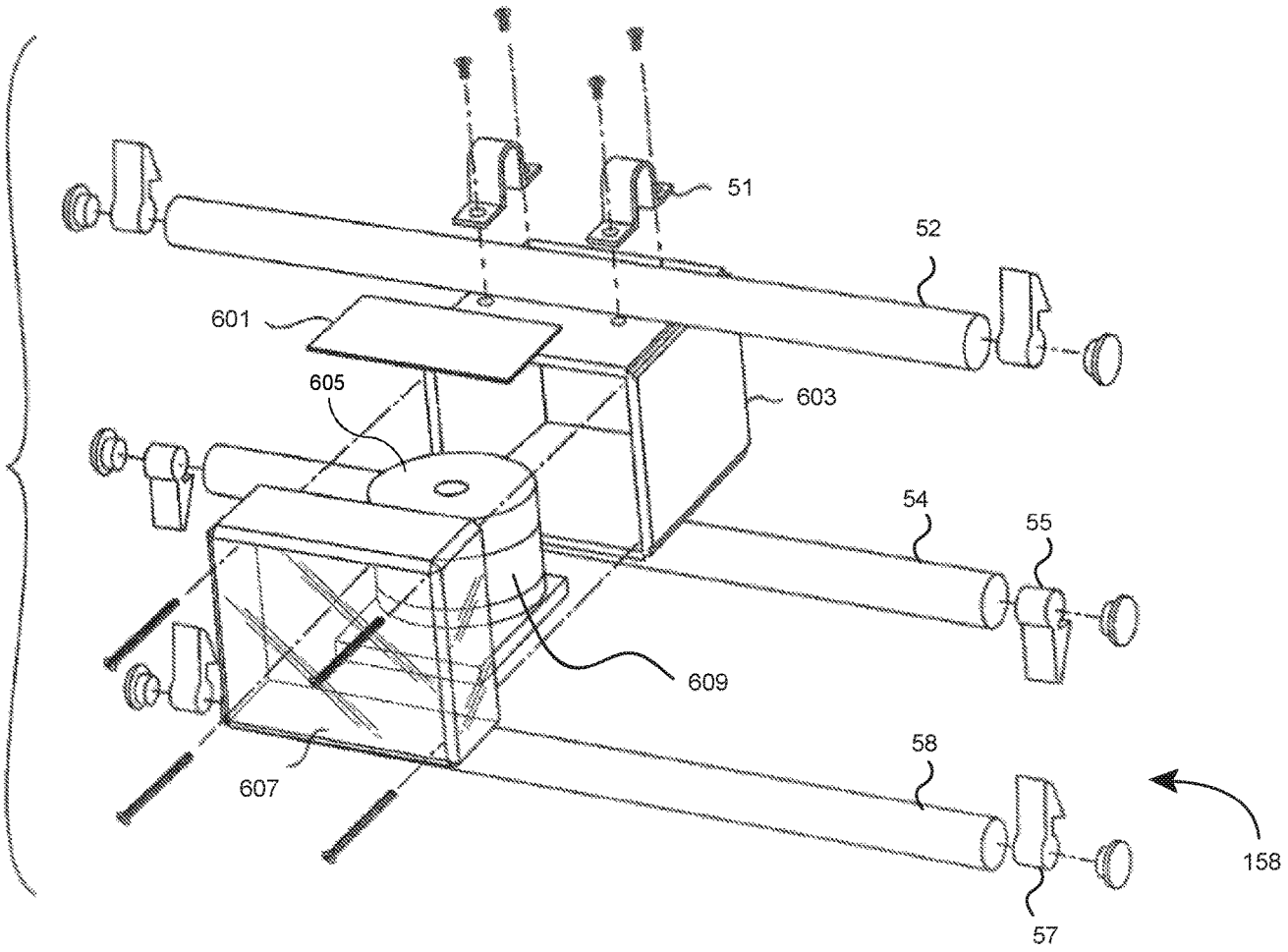
FIG. 4 is an exploded view of the base station of FIG. 3.

FIGS. 3 and 4 respectively provide assembled and exploded views of an embodiment of a base station (50). The target base station (50) will generally include an electric or similar motor (605) (in the depicted embodiment, it is an electronic stepper motor) that allows it to adjust the shooting target (56). Adjustment occurs by having the frame (158) that supports the shooting target (56) be moved by the motor (605) in the base station (50). This movement will generally be rotational and will allow the target (56) to move through a variety of positions and rotations, but it may also allow for linear movement both toward and away from the shooter or generally parallel to the shooter.

Figure 6:
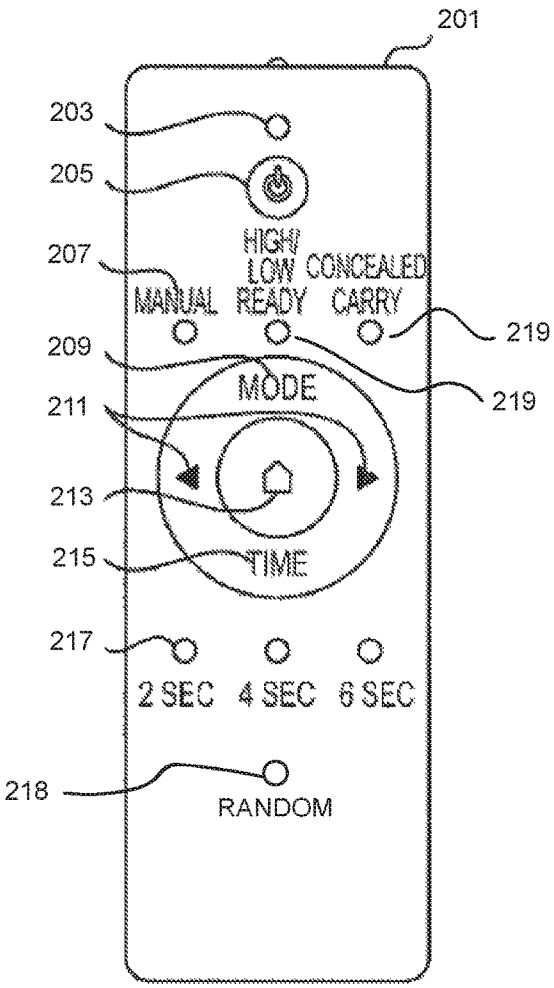
FIG. 6 shows an embodiment of a remote control system.

The base station (50) may include a variety of other components to provide for functionality and will often include a circuit board or similar computer controller (601) which can send and receive signals from a wireless controller (201), such as that shown in FIG. 6, can serve to activate the motor (605) in accordance with proposed movement demands, and which can interpret impacts if that functionality is provided. The motor (605) and computer controller (601) will generally be positioned within a housing (603) to inhibit damage to the components.

In an embodiment at least the front face (607) of the housing (603) may be designed to survive bullet or other projectile impacts to inhibit the likelihood of damage to the mechanisms of the base station (50) if the user misses the target (56) and hits the base station (50). The housing (603) may include appropriate power systems to power the motor (605) and computer control (601). The power system will often be some form of portable self-contained electric system such as a battery (609) or generator, but may include other systems known to those of ordinary skill in the art such as plugged in systems and hydraulic or pneumatic systems.

Figure 5:
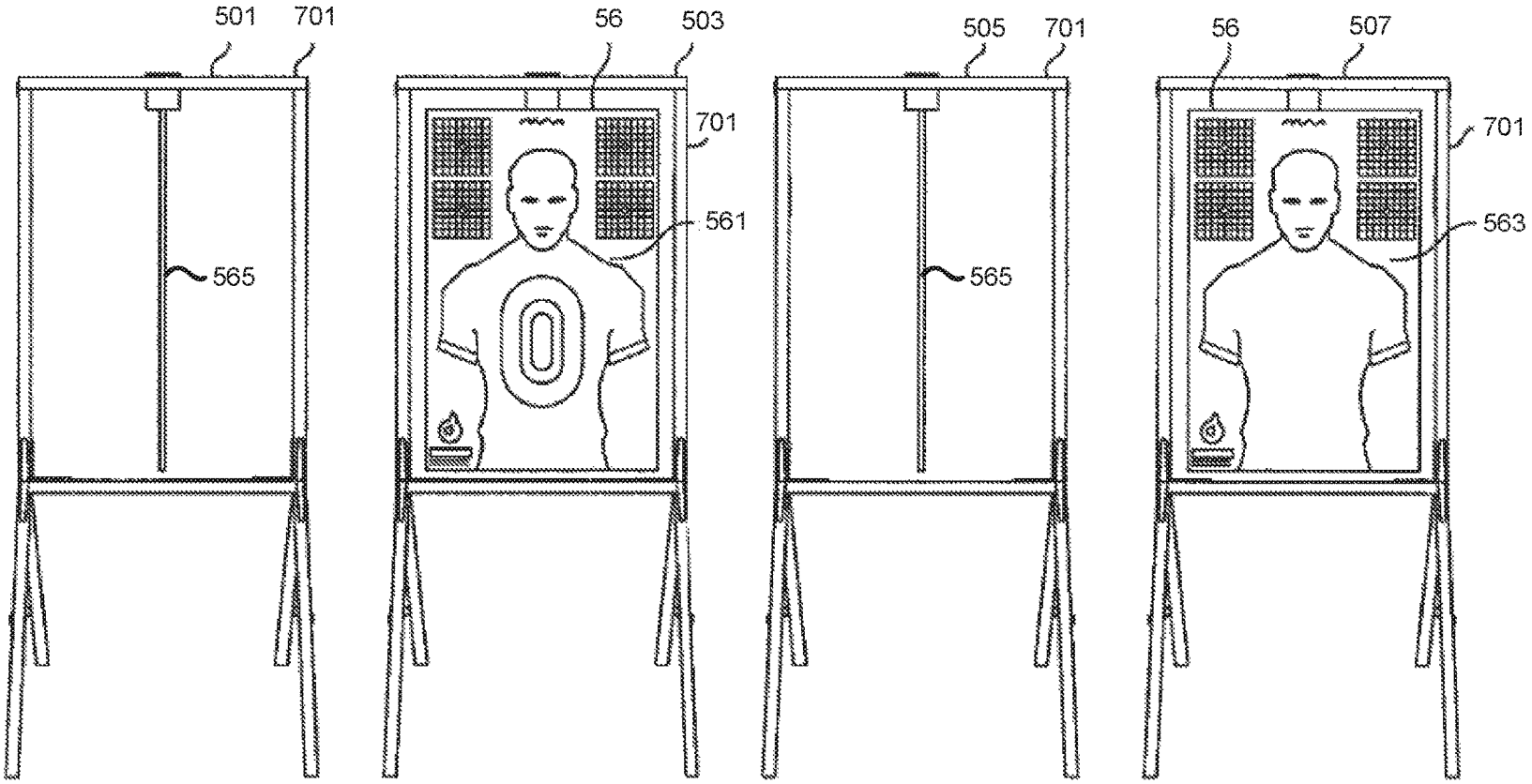
FIG. 5 shows an embodiment of a procession of target movement from a home (side) view, to a threat view, return to a home view, and to a no-threat view.

As can be best seen in FIG. 5, the target (56) in an embodiment is designed to be generally planar and to have two imaged sides. A first side (561) of the target (56) will generally be a "threat" side and will have a target presentation which is designed to indicate that a shooter should shoot the target when that side is presented. The "threat" image will often provide some kind of indicator representative of a threat which is recognized by the user as a threat indicator. For example, the image may be presented in a particularly aggressive color (such as red) or may provide an image of an individual holding a handgun or similarly dangerous item in a threatening position. The second opposing side (563) of the target (56) will generally include a "non-threat" image. This will be different from the "threat" image and may present a more neutral or passive color (such as green) or may provide an image of an individual holding a cell phone instead of a handgun. In the depicted embodiment the first side (561) of the target shows a human silhouette with a target on it while the second side (563) shows a silhouette with no target present.

It should be recognized that depending on the type of scenario the target (56) is for use in, and the type of shooting occurring, the target image may or may not be something which is printed or depicts a particular item. For example, on a sniper target (56) the image may simply be a color of the entire surface of the target. Similarly, the non-threat "image" may be that there actually is no image visible. That is, the target surface is blank (e.g. solid white or black) while the threat image actually depicts a threat such as an individual holding a handgun.

As should be apparent, in order to provide flexibility to the target system, targets (56) will generally be provided with both a threat and a non-threat image side. However, in some embodiments, targets (56) may be provided which include two threat or two non-threat images. This can provide for greater flexibility to the system (10) and to help defeat any involuntary detection that the image is likely a threat or non-threat without the shooter active cognitively processing the actual image. Similarly, targets (56) may be provided with a variety of different threat and non-threat images as part of a modular target package to provide for both flexibility and variation for the shooter.

In operation, the base station (50) can serve to rotate the target (56) into what are generally four different positions (501), (503), (505) and (507) as is illustrated in FIG. 5. These positions generally correspond to the four "sides" of the target (56). As should be recognized, because most targets (56) are generally planar objects with very little width (being a sheet of paper or metal) two of these "sides" actually correspond to the edges (side or top or bottom) of the target (56). As should be apparent, these positions present no target which is intended to be shot (and which all but a particularly skilled marksman would certainly miss). Thus, should the shooter see a target (56) in these "side-on" positions (which may be referred to as the "home" position (501) or (503)) they are not really presented with a target to shoot at.

From the home position, the base station (50) will generally cause the target (56) to rotate to present a different side of the target (56) to trigger a shooter reaction. If this rotation is to position (503), this is the threat image (561) and the user is expected to shoot at the target. Alternatively, it this is position (507), the non-threat image (563) is shown and the shooter is expected to hold their fire. The key here is that the home position will generally be used as a starting point or rest position, however that is not necessary and the home position can be used as a decision position itself. This is particularly true when multiple base stations operate together as part of the scenario.

In order to provide for a valuable training simulation, as well as a potentially entertaining shooting environment, the base station (50) will generally be capable of providing the target in either of its image positions (503) and (507) for a certain limited period of time. This time can correspond to, for example, the expected amount of time it would take an enemy to raise their own weapon and pull the trigger, or for them to cross a hallway or other visibility point. However any length of time may be used and the time of presentation may be set by the remote control (201) as indicated later. After the presentation of the particular time has been made, the base station (50) will rotate the target to a different position. This may be a home position (501) or (505), or another presentation position (503) or (507).

The present base station (50), because it primarily uses an electronic motor (605) and does not require connection to a control infrastructure for pneumatic power, can provide for a number of rotational effects beyond those provided by traditional pneumatic systems. In the first instance, the target (56) can rotate to or from any position (501), (503), (505), or (507) in either direction, simply by reversing the power inflow into the motor (605). This means that a shooter cannot effectively guess the face to be presented to them by seeing the target (56) rotate a previous time. Similarly, the motor (605) also need not carry out a single 90 degree rotation between a face and one specific home, forward and back. When the target (65) is rotated it may rotate 90 degrees, 180 degrees, 270 degrees, 360 degrees, or more in either direction, this means that a shooter can be presented with any image, from rotation in any direction, from any starting point. This can allow the home position (501) to rotate to home position (505) to effectively provide for an additional "hold-fire" position. It can also allow a non-threat presentation (507) to immediately rotate to a threat presentation (503).

As should be apparent, while the present embodiment contemplates a generally planar target (56) with two image faces (561) and (563) and two "presented" side edges, this is by no means required. In more sophisticated embodiments, the target frame (158) may be designed to support a greater number or shape of targets (56). For example, four single sided targets may be presented in a square arrangement so that each position (501), (503), (505), or (507) brings a new image. Also, a target may be presented with any of its six sides visible, or even partially obscured (e.g. at an angle other than perpendicular to the user) to provide for further functionality.

In an embodiment, multiple base stations (50) may be electronically linked together to provide for multiple targets (56) which operate in conjunction and coordination with each other. For example, a number of targets (56) may be positioned side by side which each move in accordance with the position of another target (56) in the arrangement. Alternatively, the targets (56) may be presented serially (one behind the other). This latter option can provide for a particularly interesting challenge as a shooter may need to make an assessment when presented with a threat face (561) at a farther target if they should take the shot knowing a nearer target may rotate to a non-threat face (563) where they are supposed to hold fire. This reaction and determination has to be made before they pull the trigger and if they choose to shoot, the closer target may block their view of the more distant target at any time. This can provide for the shooter to need to react not just by shooting the threat target, but by moving as part of the engagement to clear their line of sight to the further target.

Communication between base stations (50) may be provided by any communication protocol known now or later discovered including, but not limited to, Bluetooth™ Wi-Fi, or other wireless or wired connections. Generally, the communication will occur wirelessly to aid in the modularity of the system (10) and the communication infrastructure and instructions will be included on the computer control (601). Coordinated control may be done using an ad hoc network formed of base stations (50) and programs (such as those that may be stored in an internal memory on the computer controller (601)), or may be through a centralized control, such as the remote controller (201). In a preferred embodiment, the remote controller (201) can have a random option (218) for the time mode (215). When the computer controller (601) receives a random option (218) instruction from the remote controller, the computer controller runs a randomizing algorithm that produces a range of time delays before each of the activations of the motor to turn the target. Preferably, the randomizer operates to produce time delays according to a normal curve that may be centered at a mean time delay value (such as 4 seconds) between a minimum time delay (such as 1 second or less) and a maximum time delay (such as 15 seconds).

Because the system (10) is designed to provide for both shoot and hold-fire positions, in an embodiment, it can also be desired for the system to be able to determine if the user acted correctly in the correct circumstance. While a shooter will generally know as each target (56) is presented if they reacted correctly, without an observer or other objective measure of success, they may not be able to keep the score of their performance over an entire shooting house or range correctly. This can be particularly true if the base stations (50) are designed to present the faces (561) and (563) randomly, so there is no record of which facing was presented when the shooter was in any particular location. In a scenario where a user is likely highly focused on their performance at each individual target (as they should be in a shooting house type of arrangement), this means that accurate score keeping can be very difficult. Further, with a two sided paper target, it will often be difficult to determine from which side a bullet impacted the target although this can sometimes be used as a default. However, if the target may present multiple faces during the shooting activity, this may also be an untenable scorekeeping method.

To aid in scorekeeping, the base station (50) can, in an embodiment, include an impact recognition system. In an embodiment, projectile impact recognition occurs when a projectile impacts the target (56) and an electrical signal is sent to the target base station (50). This may be, for example, by the bullet breaking a wire in the target (56) or otherwise altering properties of the target (56) so its position can be detected. It may also be by the base station including audio systems that detect the percussion sound of the firearm discharging and whether the bullet simply hit the target (56) at all. The target base station (50) preferably responds by either storing scoring information for later retrieval or by processing the score as an electrical signal and sending the impact data to the target controller (501) using the same connection from which it receives instructions. From the target controller (501), information from the impact data may recorded or displayed at any time during or after the shooting scenario.

While a target controller (201) is not necessary and control of target (56) rotation and impact detection, if present, may be performed entirely at the base station (50), it is generally preferred that a remote controller (201) be provided. The target controller (201) is preferably used to send commands to the target base station (50) that control the target (56) adjustments. The target (56) adjustments can include positional and pace adjustments in the process of a shooting cycle to challenge the shooter as well as allowing for setting of various features of the shooting. The controller (201) may be provided as a dedicated remote control as shown in FIG. 6, or may be provided as a software or similar application (for example, an "app") which may be run on a shooter's or other user's smartphone or network connected computer device. The former is generally preferred for security and safety reasons, but is not required and the later can reduce hardware costs in a commercial system.

FIG. 6 provides an embodiment of a remote control (201) and gives some indication of some of the options for control over the target (56) that can be provided. In the embodiment of FIG. 6, the remote control (201) includes general power controls (205) and an associated power indicator light (203). It can also include a mode selector (209) and associated indicators. In the depicted embodiment, the modes can correspond to a manual control mode which would commonly be used if someone other than the shooter is operating the remote control (201) as this will allow them to alter the presentation in accordance with their own pattern, or modes such as concealed carry and high/low ready to provide particular arrangements and patterns useful in particular training scenarios. The computer controller can have preset exposure times, such as 1.5 seconds, 3 seconds, and 5 seconds that are pre-programmed options for the duration of time that the target is presented. Additionally, these exposure times can be selected by the remote controller, and a fully programmable remote controller working with the computer controller can randomize the exposure times.

There can also be manual control buttons on the remote control (201) such as left and right rotation (211) and home (213) which will cause the connected base station or stations (50) to select particular positions and rotation in manual control. As should be apparent, hitting a button repeatedly, could cause multiple rotations or shifts consecutively. Similarly, the user may manually select a time mode (215) which will provide for how long a particular position is maintained without other user input, or how difficult (e.g. fast) a particular prepared mode may run. This selected time will generally also be indicated on an indicator (217).

As has been indicated previously, the base station (50) can provide target range modularity with the ability to centrally (or ad hoc) control a number of base stations (50) in conjunction with other bases stations (50) to provide for coordinated shooting activities. Further, the base station (50) can positioned virtually anywhere to provide very flexible arrangements. While the system (10) will often be used in conjunction with prepared infrastructure (such as a shooting house or range), this is not necessary with the system (10) and, in an embodiment, the system (10) does not need any form of infrastructure to be used.

In this arrangement, the system (10) can be setup to provide for a live fire range anywhere it is safe to do so. For example, the range can be setup in a relatively open field, in an arena with moveable obstacles and barriers, or even in a city or town where there are no potential dangers from people wandering into the range. To provide for this type of arrangement, the base station (50) may be provided with a prepared stand (701) which can be positioned as desired or base stations (50) may simply be positioned on available infrastructure. This allows the base station (50) to not only be used in specific shooting houses and shooting ranges, but anywhere ammunition may be expended safely.

Figure 7A:
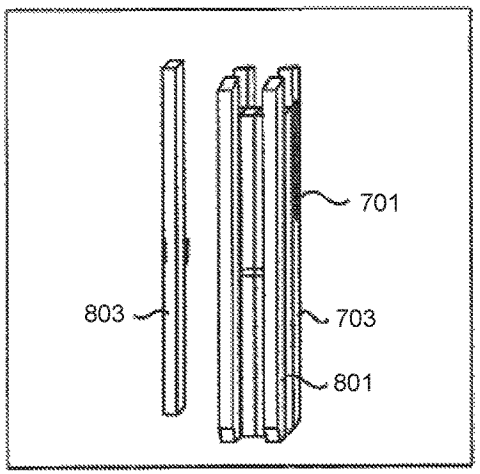
FIGS. 7A, 7B, 7C, 7D, 7E, and 7F show assembly steps of a collapsible stand useable with the target system of FIG. 2.

In a particular embodiment, the stand (701) is a stand-alone unit which is comprised of a frame (703) which is constructed from common lumber materials or synthetic equivalents such as plastics. In some instances the frame (703) is constructed from two by four wood. FIGS. 7A-7F provides an embodiment of a repeatedly constructible and collapsible stand (701) which can be used with a base station (50). As can be seen in the montage images of FIG. 7A-7F, the stand (701) can be easily transported to any location in a folded fashion (FIG. 7A), set up (FIGS. 7B-7E), and the base station (50) can then be attached to the top or bottom of the main opening (705) of the stand (701) in the finalized assembly (FIG. 7F). As can be seen in FIGS. 7A-7F, in an embodiment the entire frame is easily compacted for travel employing various hinges and fasteners and only two pieces, as shown in FIG. 7A, to be easily hand help for transportation.

Figure 7B:
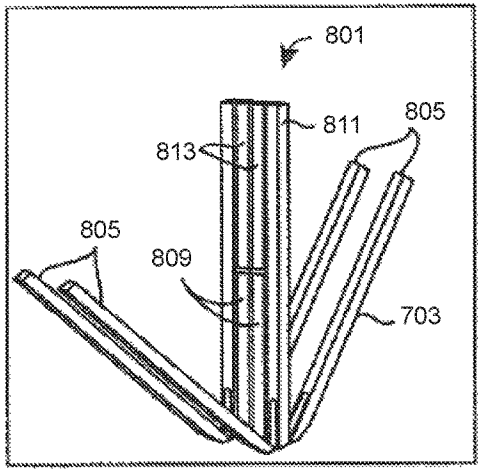
Figure 7C:
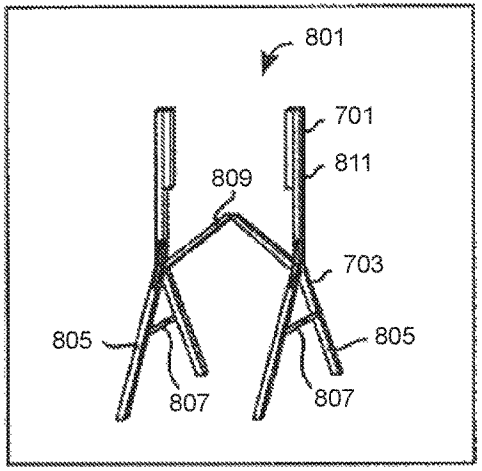
Figure 7D:
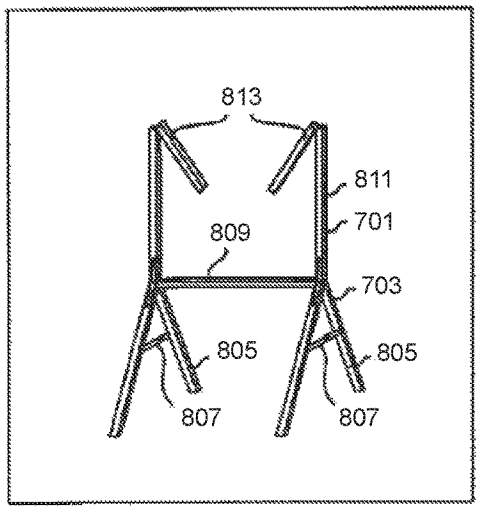
Figure 7E:
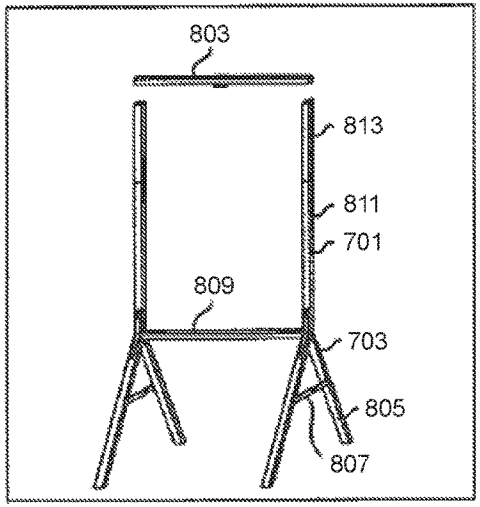
Figure 7F:
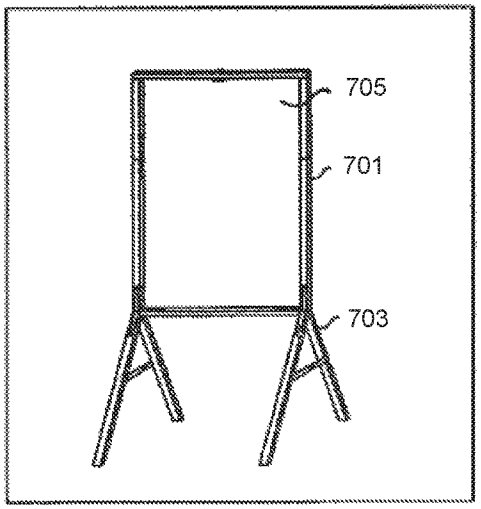

Generally, assembly of the stand (701) will occur by first removing the components (801) and (803) from a storage bag or connector (FIG. 7A), the legs (805) can then be folded down into an inverted "Y" position (FIG. 7B). Once positioned, the legs are braced (807) and moved apart to form the lower cross beam (809) (FIG. 7C). The uprights (811) then extend to their full height via rotation of top portions thereof (813) (FIG. 7D). Finally, the top cross bar (803) is added to the uprights (811) (FIG. 7E) and the stand (701) is fully assembled (FIG. 7F).

While the general assumption for the turning target system (10) is that it will be used for firearm training and entertainment purposes, this is by no means required. The target and unit can be designed to operate with any projectile weapon or device including non-lethal devices such as, but not limited to, Taser systems and paintball guns. Similarly, it can be used without the inclusion of a projectile weapon or device. For example, it can be presented as part of a simple escape scenario where a user is unarmed, but needs to make decisions about who to move toward or away from when running in a building. The modular rotation can also be useful for other types of training. For example, the rotation can be used to provide images indicative of different types of baseball pitches to allow a batter to swing in reaction to what he sees. Similarly, the target may present images of different parries to allow practice of fencing or other blade fighting lunges depending on the nature of the guard presented.

Still further, while the above primarily contemplates motion of the target (56) from rotation along a vertical axis, this is by no means required and the rotation may be along any axis. Further, multiple axes of rotation can be used in particularly sophisticated base stations (50) including multiple motors and control can be provide and multiple base stations (50) can even be connected to the same target (56) to provide for certain additional types of motion. This can allow for targets (56) to be moved from any presentation to any other including angled and partial cover presentations. Rotational movement from the base station (50) may also be coupled with linear movements by connecting the base station (50) to linear movement systems.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art. Accordingly, additional aspects of the invention are described below.

Another aspect of the present invention is a portable rotator device (900) such as shown in FIGS. 8A-8E for mounting to a support and suspending a target to be rotated having a motor held within a motor housing (603), a pivot mount (301), and a ballistic shield (303). The housing (603) itself is designed to include a mounting surface (305) proximate to the housing's top side comprised of a support mounting bracket (307). This bracket (307) can be used to affix the portable rotator device (900) to any number of supports as shown in FIG. 9. The top side of the mounting bracket (307) preferably includes elongated slots or slits (309) which permit many different types of fasteners to be used in connecting the rotator device not only to the modular support stand (701) of the present invention but to a wide variety of support structures.

As shown in FIG. 10, the various fastening means for attaching the support mounting bracket (307) to the support may include screws (105*b*), hook and loop (403) fasteners, rope (405), tape (407), large zip ties (409) or other similar means. As the fasteners used for affixing the support mounting bracket (307) to the support is not limited, it should also be appreciated that the support itself may be any number of things, including bars, tree branches (52*a*), fences (52*b*), wires, door frames (52*c*), and target frames (52*d*), including the modular target frame described herein. As indicated above, several different portable rotator device (900) supports are illustrated in FIG. 9A-9D. As the attachment means and the supports are not definite, it is an object of the present invention to provide a portable rotator device (900) that can be easily setup and used anywhere shooting is permitted.

In operation, the support mounting bracket (307) attached to the mounting side of the motor housing (603) has multiple mounting apertures that mate with at least one of the aforementioned fasteners. For example, the aperture may have a circular screw hole through which a screw (105*b*) fastener is secured while also having an elongated slit hole (309) through which a hook and loop (403) fastener is mated. Accordingly, not only can different fasteners be used with the same mounting support, but the fasteners can be combined to ensure an even more secure connection of the portable rotator to the support. Further, the multiple apertures allow the user to elect which fastening means is most appropriate for the given support where a tree limb might be better suited for a temporary tying fastener while a rotating device may be permanently mounted to the ceiling of a shooting house with fastening screws (105*b*).

The motor housing is suspended from the support by the support mounting bracket (307) proximate to the housing's top side. A rotating shaft (101) extends a distance through an aperture in the bottom of the motor housing (603) to a first horizontal plane below the bottom of the housing. In one embodiment, a pivot mount (301) is connected to the rotating shaft (101) of the motor (605). When connected, the pivot mount (301) rotates in unison with the rotating shaft (101) which subsequently rotates the target (56) as described below. Further, at least a portion of the pivot mount (301) is below the bottom edge of the ballistic shield (303) described below, and thus in the field of fire. Therefore, it is an aspect of the present invention to have easily interchangeable and low cost pivot mounts (301) which may be damaged from stray rounds.

As shown in FIG. 15, a number of configurations can adequately secure the pivot mount (301) to the rotating shaft (101) of the motor (605). In one embodiment, as seen in FIG. 15A, the pivot mount (301) is attached to the rotating shaft (101) with a steel roll pin (103) or screw (105*c*) that is slid into a void in the rotating shaft (101) and pivot mount (301). In this embodiment, the pin (103) secures the pivot mount (301) to the rotating shaft (101) through a friction fit, or pivot mount (301) is secured by the threading on the screw (105*c*). Although this embodiment has the screw (105) or pin (103) inserted horizontally, another embodiment uses the screw (105*c*) or pin (103) securing method wherein the screw (105*c*) or pin (103) is inserted vertically through the bottom of the pivot mount (301) into the rotating shaft (101). Such an embodiment is seen in FIG. 15C. Another embodiment uses a hex-shaped male and female connection (107) between the rotating shaft (101) and the pivot mount (301). And as shown in FIG. 15B, this male and female friction connection (107) can be combined with a pin (103) or screw (105*c*) inserted through a void to provide a stronger hold. In addition, this male and female connection (107) can be combined with any of the other embodiments and is not limited to the hex shaped seen in FIG. 15B.

Figure 15C:
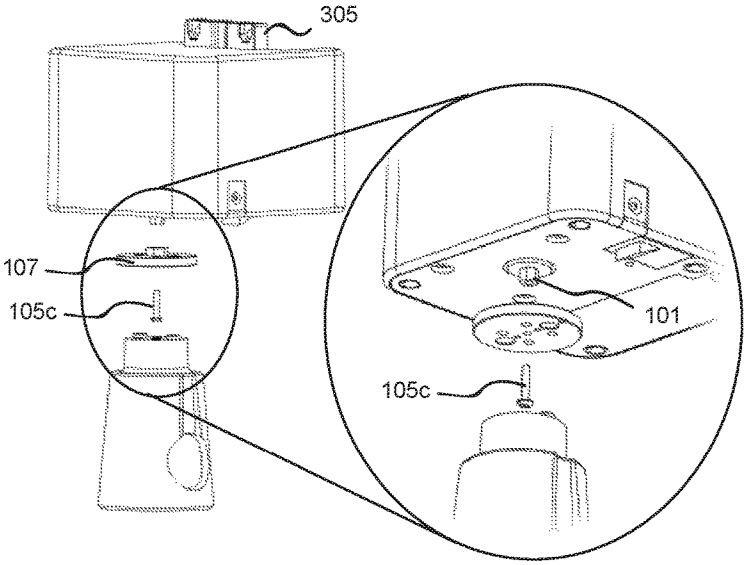
FIGS. 15A, 15B, 15C, 15D and 15E are detail views of various connections between the pivot mount and rotating shaft according to the present invention.
Figure 15B:
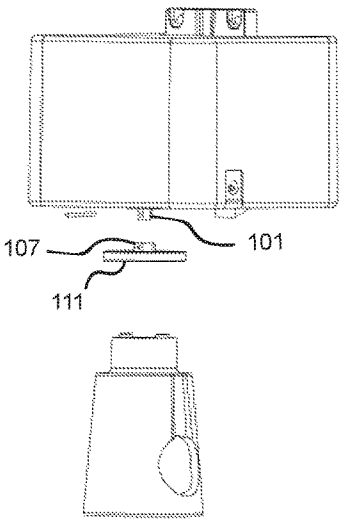
Figure 15A:
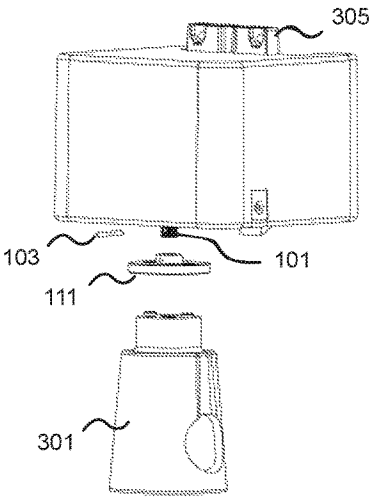
Figure 15D:
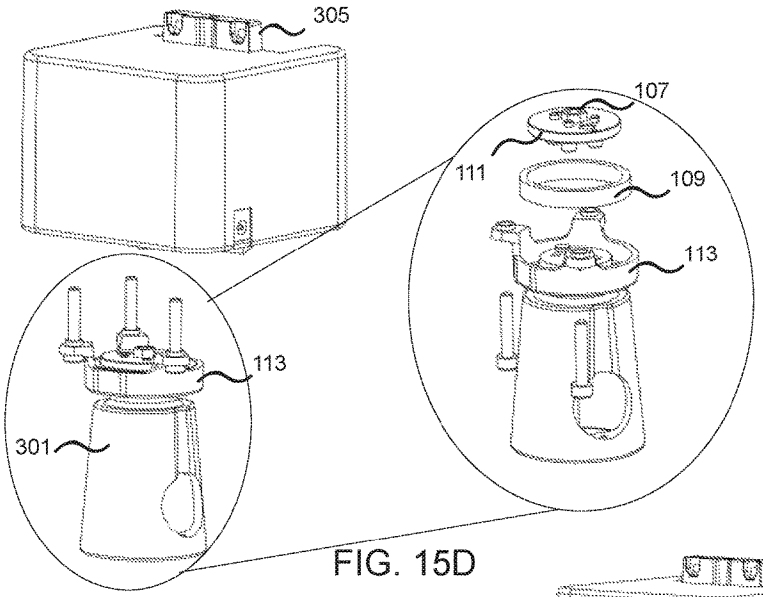
Figure 15E:
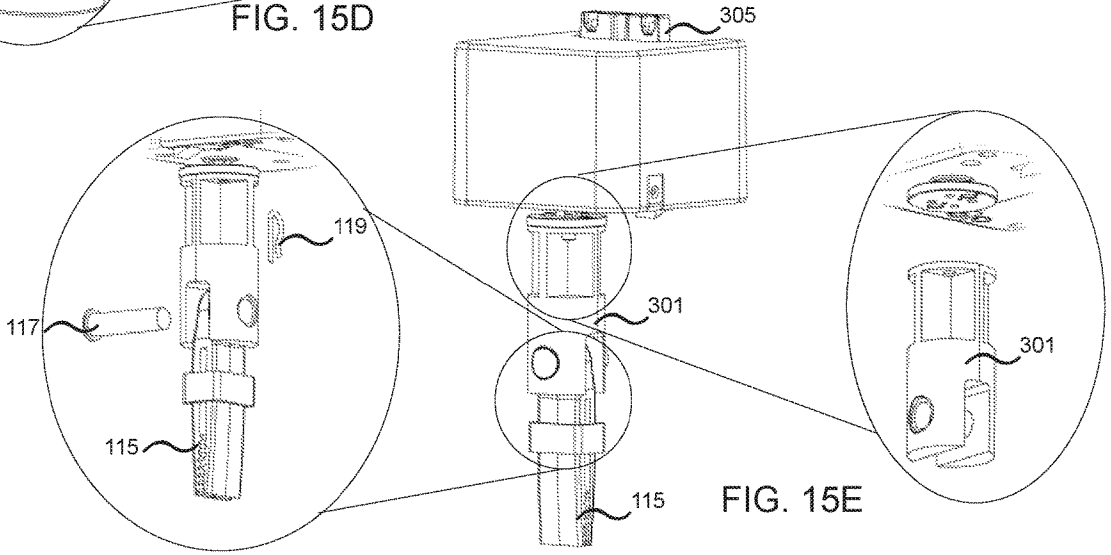

In another embodiment shown in FIG. 15D, the pivot mount's (301) connection to the rotating shaft (101) is supported by a bearing (109) and hex gear (111) that are held in place by a motor stabilizer (113) that is connected to the bottom of the motor housing (603) wherein the rotating shaft (101) is attached to the pivot mount (301) through a bearing (109) assembly. The bearing (109) connection shown in FIG. 15D includes a female hex gear (111) that rotates the pivot mount (301) in unison with the rotating shaft (101) and an outside collar screwed into the bottom of the housing keeps the pivot mount (301) attached to the motor housing (603). Another embodiment depicted in FIG. 15E has a simple target clip (115) attached to the bottom of the pivot mount (301) through a bolt (117) and pin lock (119). Any one of the previously mentioned methods for attaching the pivot mount (301) to the motor housing (603) and/or rotating shaft (101) can be outfitted with the single target clip (115) embodiment, rather than the more intricate target arm (313) described below.

Another aspect of the portable rotator device (900) is a ballistic shield (303) mounted to at least one of the mounting side of the motor housing (603) and the support mounting bracket (307), as seen in FIG. 8. Where the motor (605) and housing (603) are designed to be light weight and portable, the ballistic shield (303) protects from stray bullets that may otherwise hit and potentially damage the light weight motor (605) and housing (603). The ballistic shield (303) is comprised of a shield mounting bracket (311) that is either attached to the mounting side of the housing or directly attached to the support mounting bracket (307). Neither embodiment is preferred where it is an aspect of the present invention to allow the ballistic shield (303) to be used with any of the supports that a marksman may have available. Thus, the ballistic shield (303) may be affixed to a support that is outfitted to separately hold both the motor (605) and the ballistic shield (303), like the frame described herein. But also, the ballistic shield (303) can still be used to protect the motor (605) when the support is not readily equipped to hold both motor (605) and shield individually, like a tree branch (52*a*).

Figure 8B:
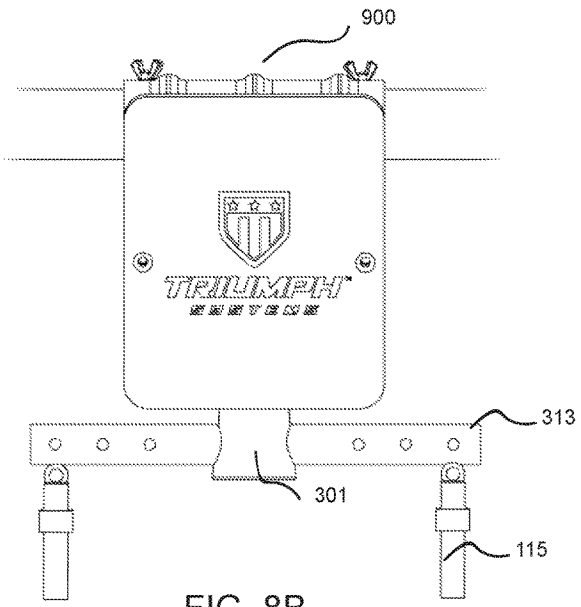
FIGS. 8A, 8B and 8C show perspective, front and side views of the portable rotator device of the present invention.
Figure 8A:
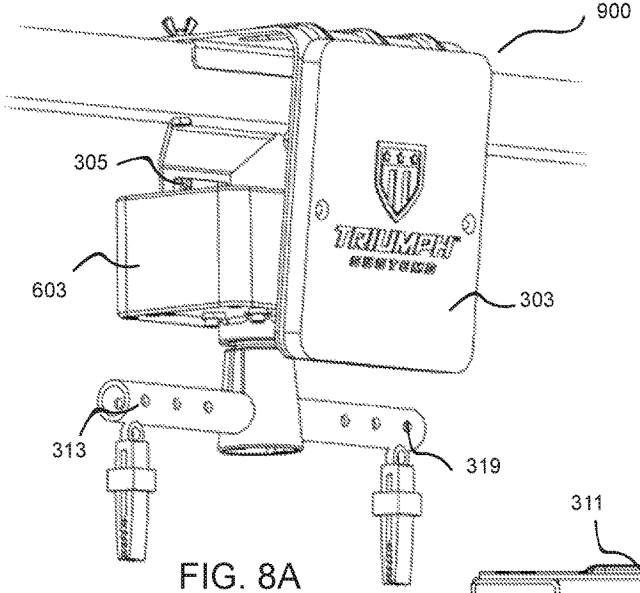
Figure 8C:
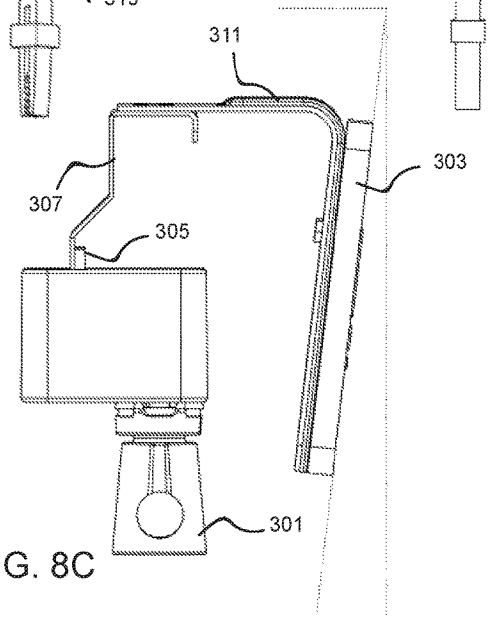
Figure 8E:
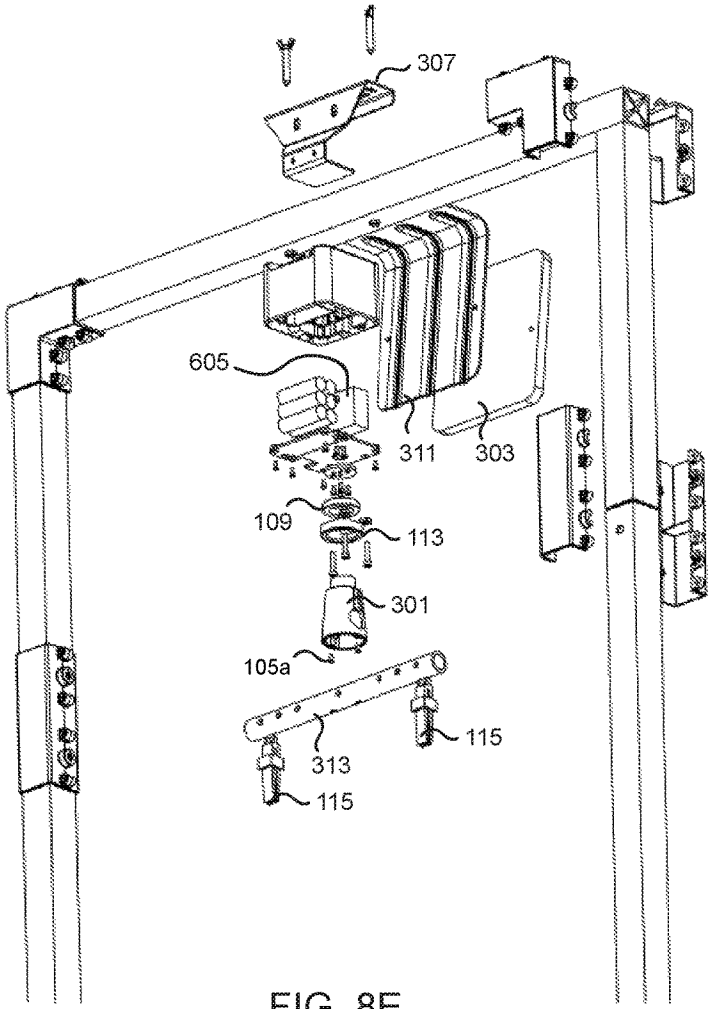
FIGS. 8D and 8E depict exploded views of the portable rotator device of the present invention.
Figure 8D:
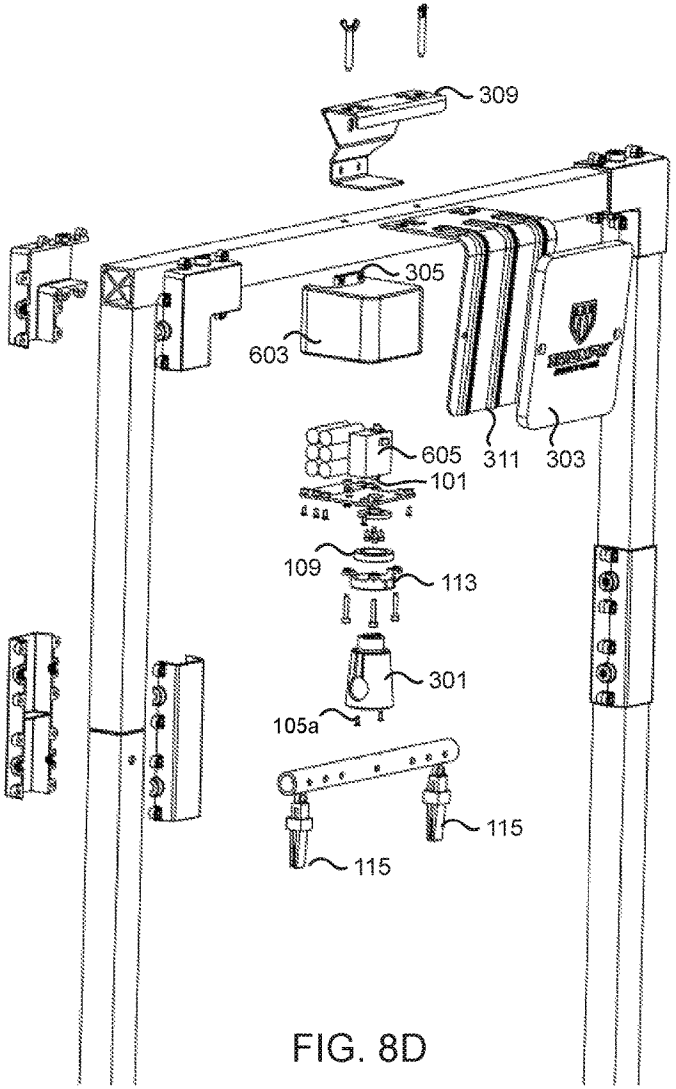
Figure 9A:
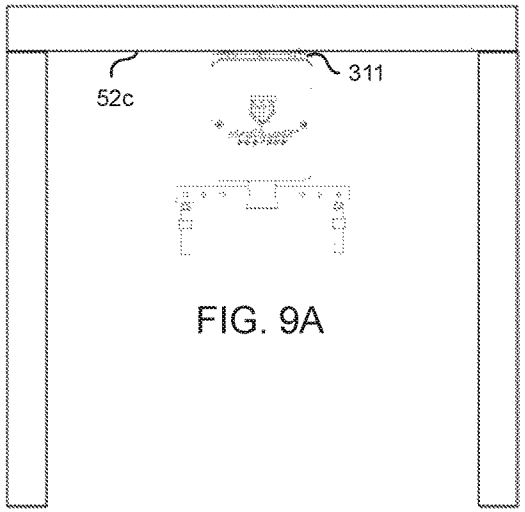
FIGS. 9A, 9B, 9C and 9D depict various supports being used according to the present invention
Figure 9C:
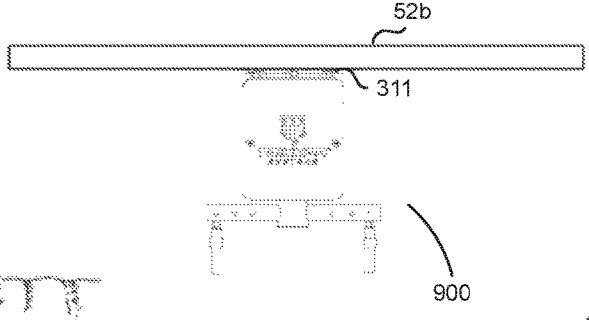
Figure 9B:
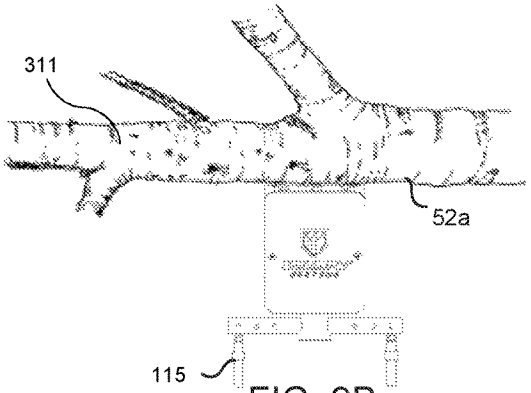
Figure 9D:
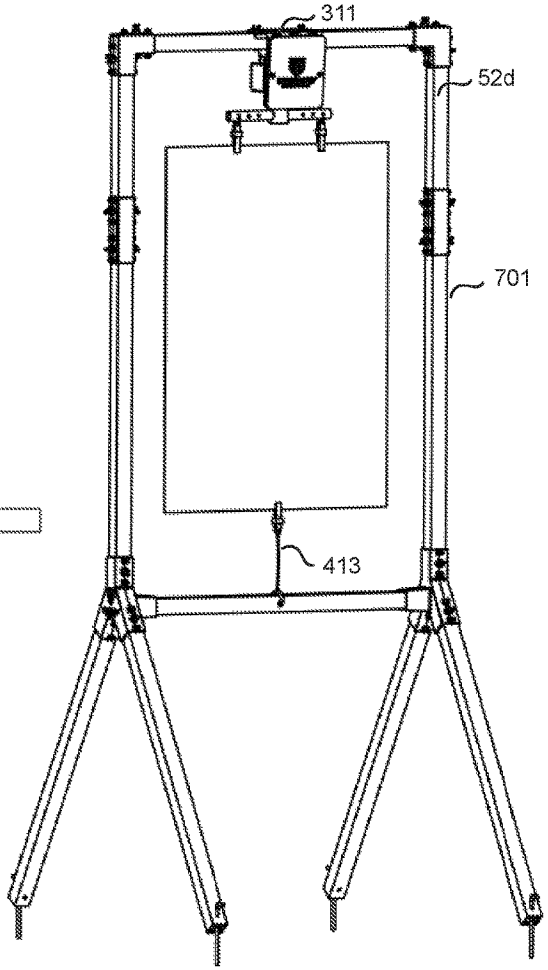

As seen in the exploded views of FIGS. 8D and 8E, the shield mounting bracket (311) is generally an inverted L-shaped-bracket wherein one side of the "L" is attached to the support mounting bracket (307) or motor (605) and the other side of the "L" is attached to the back of the ballistic shield (303). In this embodiment, the connection between the pivot mount (301) and the rotating shaft (101) is supported by a bearing (109) that is held in place by a motor stabilizer (113) that is connected to the bottom side of the housing (603). As shown in FIG. 8C, the shield support bracket separates the back face of the ballistic shield (303) a distance from the front face of the motor (605) and extends downwards to a second horizontal plane below the first horizontal plane to which the rotating shaft (101) extends. In the preferred embodiment the entire structure of the motor (605) and housing (603), including the rotating shaft (101), is protected from stray bullets fired from the front. In the preferred embodiment only the pivot mount (301), or a portion thereof, the target arm (313), the target clip(s) (115) and the target (56) are visible to a shooter. Additionally, the bottom edge of the ballistic shield (303) is angled inwardly towards the vertical axis (610) of the rotating shaft (101) from the top edge. Thus, the ballistic shield (303) is not parallel to the front face of the motor housing (603) and is instead slightly angled towards the ground. This angled shield causes projectiles that happen to hit the shield to be deflected towards the ground rather than directly back towards the shooter.

As stated, the pivot mount (301) is subject to being hit by stray bullets where it is not completely protected by the ballistic shield (303). Because of the potential damage a stray bullet may cause, in the preferred embodiments pivot mounts (301) are made from inexpensive materials like plastic or recycled metals and are not designed to be completely resistant to bullet damage. Instead, it is an aspect of the present invention to have easily interchangeable pivot mounts (301) that can be quickly swapped in and out should a pivot mount (301) become damaged by a stray projectile. Also, the independent nature of the motor (605), housing (603) and pivot mount (301) contribute to the modular target system design.

Another aspect of the present invention is a target arm (313) that is secured to the pivot mount (301) and thereby rotates in unison with the rotating shaft (101) of the motor (605). As shown in FIGS. 8 and 11, the pivot mount (301) has a circular aperture proximate to the bottom of the pivot mount (301) wherein the target arm (313) may be inserted and secured with a friction fit. In another embodiment screws (105*a*) can be used to hold the target arm (313) in place within the aperture of the pivot mount (301). The target arm (313) itself is designed to be of a standard length and circumference that is readily available to any marksman. Therefore, the target arm (313) is designed to be made from inexpensive and readily available material like PVC pipe, wood, and other similar materials that are cut to conventional dimensions. In addition to being inexpensive, target arm material is intended to be light weight to allow the electric motor (605) to rotate the target arm (313) and suspended target (56) through its many degrees of rotation without unneeded stress from excess material weight. It is another aspect of the target arm (313) to have a series of apertures (319) spanning the length of the target arm (313) wherein the target clips (115) may be suspended therefrom. As the target arm (313) is intended to be inexpensive, a user may purchase a target arm (313) with a series of pre-drilled holes or a marksman may drill them themselves in any of the above referenced or other target arm (313) materials.

Figures 11A, 11B, 11C, 11D:
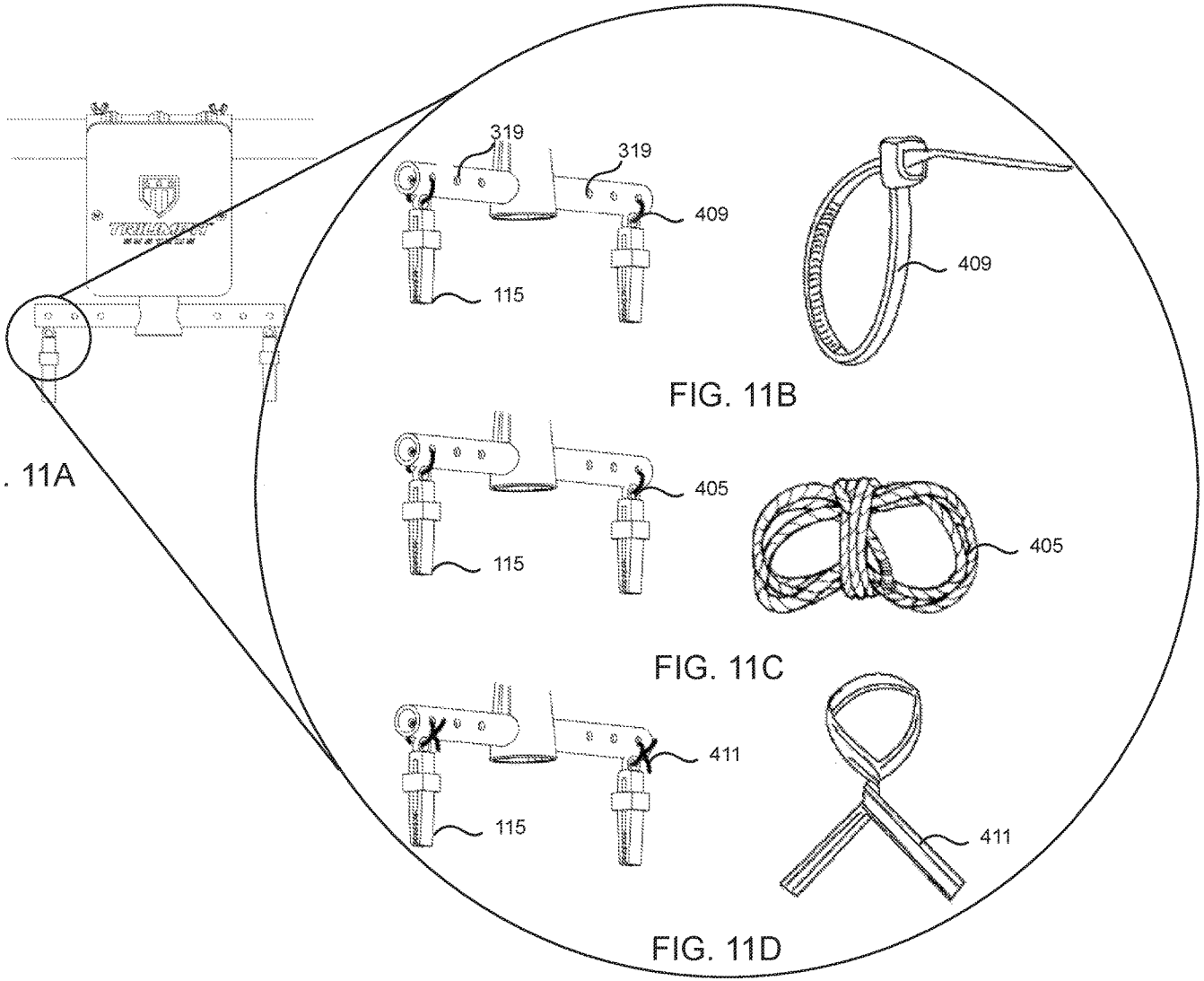
FIGS. 11A, 11B, 11C and 11D depict various embodiments of target clips according to the present invention
Figures 12A, 12B, 12C, 12D:
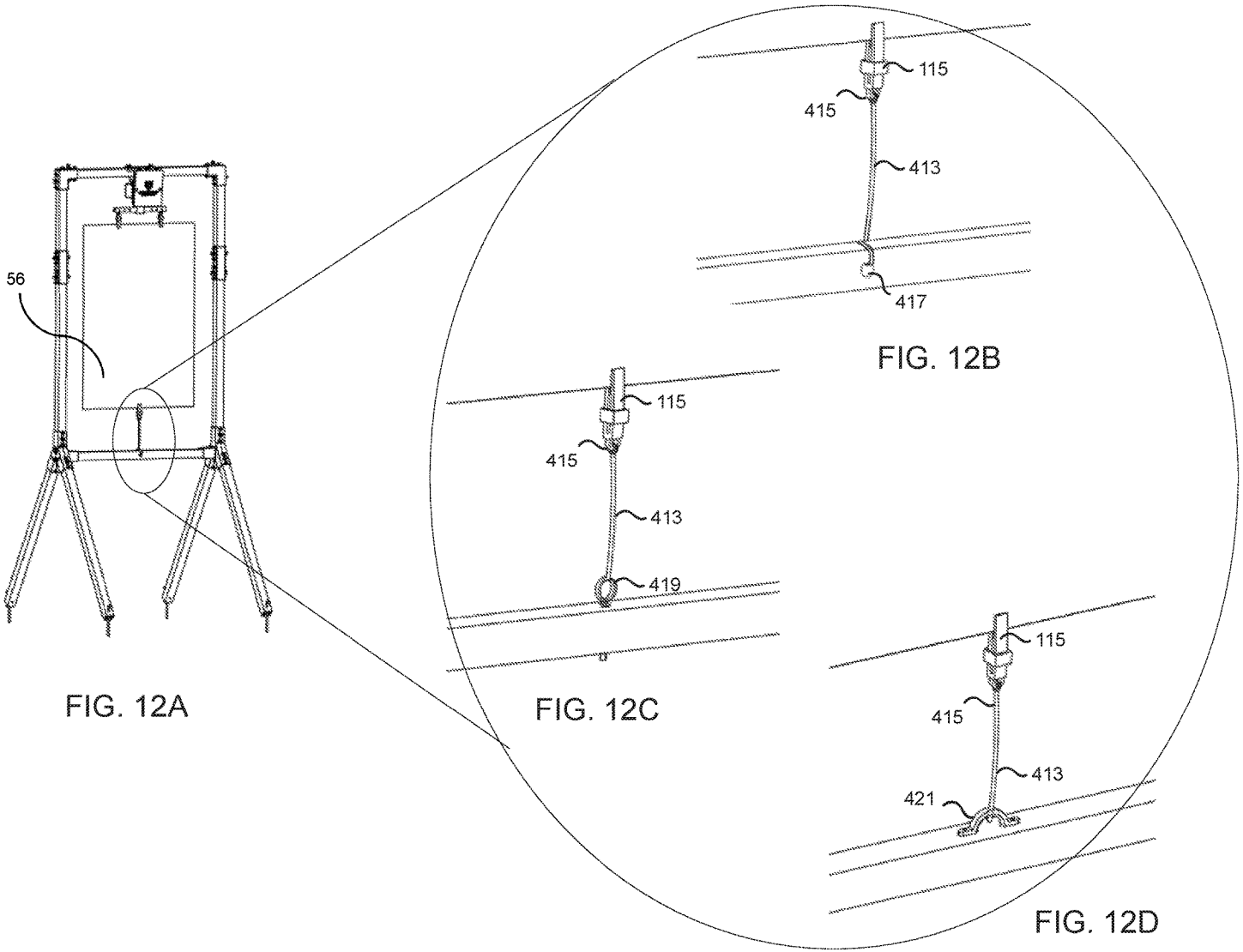
FIGS. 12A, 12B, 12C and 12D depict variations of the target tether according to the present invention.

Illustrated in FIG. 11 and mentioned above, the target clips (115) may be suspended from the target arm (313) with a number of items. These items include zip ties (409) (FIG. 11B), rope (405) (FIG. 11C), and twist ties (411) (FIG. 11D). Although not all of the apertures may hold a target clip (115), the series of apertures (319) allows a marksman to determine how secure they would like to make the target (56) where they may affix one or multiple target clips (115). As shown in FIG. 12, the preferred embodiment uses a plurality of target clips (115) to suspend the target (56) about its top edge wherein the target (56) rotates in unison with the target arm (313). Further, another aspect of the portable rotator device (900) is a tether (413) removably affixed to a bottom edge of the target (56). As the target (56) suspended from the target clip(s) (115) is typically planer and made of paper or a similar light weight material, wind, centrifugal force as the target (56) rotates, and being repeatedly hit with projectiles may cause the light weight target (56) to move in unintended directions. To combat these effects, the present invention includes a target tether (413) or lashing that is attached to the bottom edge of the target (56) along the vertical axis (610) of the rotating shaft (101) of the motor (605) wherein tension is kept on the suspended target (56). As the target (56) rotates, the tether (413) holds down the bottom edge of the target (56) and ensures that the target (56) is fully visible in all presentation positions regardless of wind conditions, rotation rate, or caliber of projectile hitting the target (56).

Figure 13B:
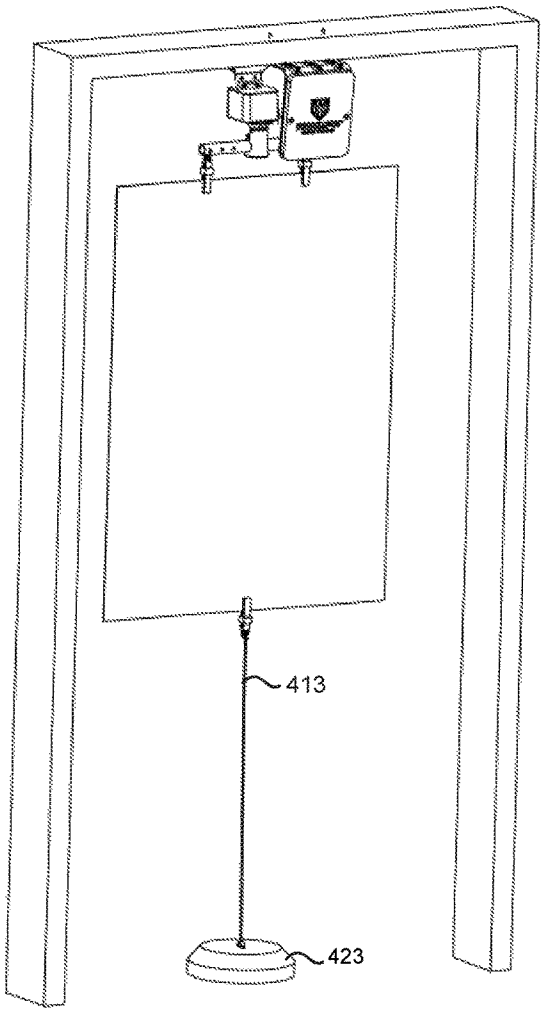
FIGS. 13A and 13B depict variations of the anchors used in combination with the target tether according to the present invention
Figure 13A:
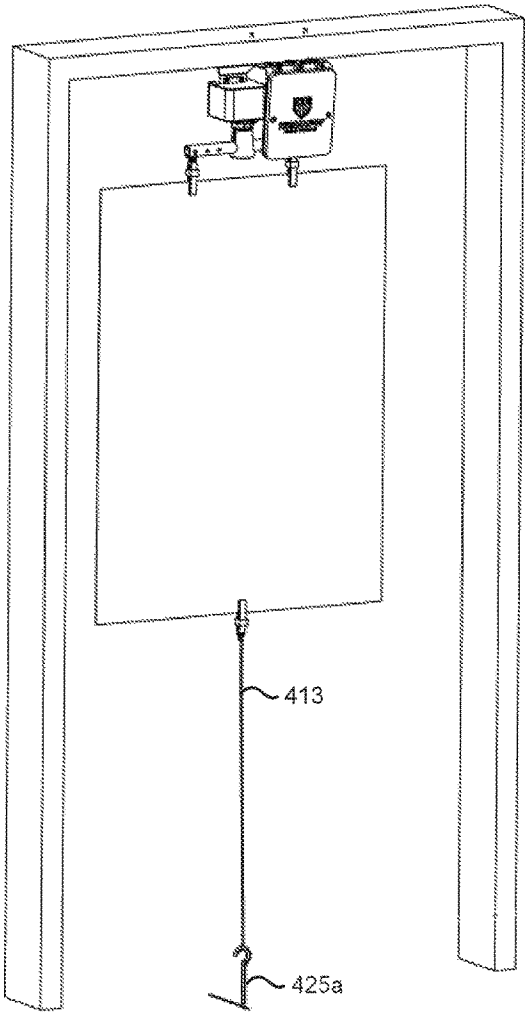

As shown in FIG. 12, the tether (413) in the preferred embodiment is attached to the bottom edge of the target (56) by a target clip (115) and swivel (415). At the opposite end of the target clip (115) and swivel (415), the tether (413) is attached to an anchor. In one embodiment the anchor may be the support itself, as shown in FIG. 12 where the tether (413) is connected to the modular frame (701) described below. The tether (413) is attached to a bottom cross bar (58) of the frame (701) which can be accomplished through multiple ways. As shown, the lashing may be secured to the anchor by a hole (417) within the frames (701) bottom cross bar (58), a swivel eye screw (419), or a saddle bracket (421). These securing methods are merely exemplary and other similar means may be used to secure the tether (413) to a support. In another embodiment, the tether (413) may not be secured to the support where the support is not fit for such a configuration. For example, if the support is a tree branch (52*a*) or straight bar, other types of anchors may be used. As seen in FIG. 13, in cases where there is not a readily available anchor support a weighted base (423) (FIG. 13B) or a ground stake (425*a*) (FIG. 13A) may be used. It follows that other types of anchors may be used depending on the environment the marksman is shooting in and the materials they may have available.

The portable rotator device (900) primarily uses a batter powered electronic motor (605) which does not require connection to a control infrastructure for pneumatic power and can provide for a number of rotational effects beyond those provided by traditional pneumatic systems. It is an aspect of the portable rotator (900) to have a degree of rotation between 0 and 360 degrees. In the first instance, the target (56) can rotate to or from any position in either direction. This means that a shooter cannot effectively guess the face to be presented to them by seeing the target (56) rotate a previous time. Similarly, the motor (605) also need not carry out a single 90 degree rotation between a face and one specific edge, forward and back. When the target (56) is rotated it may rotate 90 degrees, 180 degrees, 270 degrees, 360 degrees, or more in either direction, this means that a shooter can be presented with any image, from rotation in any direction, from any starting point. This can allow a non-threat (563) presentation to immediately rotate to a threat (561) presentation. In addition, the speed of rotation can vary to better suite marksmen of different skill levels. In the preferred embodiment, the rotating shaft (101) may take between 20 and 200 milliseconds to rotate between degrees of rotation.

As the motor (605) in the preferred embodiment is a battery powered electric motor, it is an aspect of the present invention to provide a lightweight and portable target system (10) that may operate in remote areas. Where an external power source is not needed, the motor (605) is easily transportable and can be used anywhere shooting is permitted. Further, the motor (605) in the preferred embodiment is designed to be compact and stowable for easy carrying to and from shooting sites. Although this target system (10) can be used at large shooting ranges, its compact size and light weight electric motor (605) facilitate use in remote areas. These design features combined with the ability to use interchangeable support structures and attachment means provide a significant improvement over known target systems that are restricted by size, power sources, and support structures.

In addition, the battery powered electric motor (605) can be remotely controlled by the remote controller (201) shown in FIG. 1. This remote controller (201) is in wireless communication with a computer controller (601) held within the motor housing (603) which communicates with and controls the electric motor (605). In operation, the rotating shaft (101) rotates the target (56) into what are generally four different positions which can be preset or manually entered through the remote controller (201). These positions generally correspond to the four "sides" of the target (56). As should be recognized, because most targets are generally planar objects with very little width (being a sheet of paper or metal) two of these "sides" actually correspond to the edges of the target. As should be apparent, these positions present no target which is intended to be shot (and which all but a particularly skilled marksman would certainly miss). Thus, should the shooter see a target in these "side-on" positions they are not really presented with a target to shoot at.

In operation, the remote controller (201) wirelessly communicates with a computer controller (601) within the motor (605) of the device that operates the rotating shaft (101). In an aspect of the remote controller (201), a rotation randomizing control is included that allows the user to select a random pattern of rotations and times between the rotations preventing a marksman from easily predict which target (56) will be presented based on previous patterns. As stated above, the randomizer (218) delays the time between rotations within a range between zero (0) and fifteen (15) seconds. Additionally, the remote controller (201) allows the user to power on the motor with a power control (205), manually rotate the device by pressing the manual rotation control (211), as well as program a manual time delay between rotations. Also, the user can use the remote controller (201) to set the motor (605) and rotating device to one of any rotation patterns or rotation modes (219) with preset time delays and rotation speeds.

From any position, the rotating shaft (101) will generally cause the target (56) to rotate to present a different side of the target (56) to trigger a shooter reaction. If the rotation is to a position depicting a threat image (561), the user is expected to shoot at the target (56). Alternatively, if the rotation is to a position of a non-threat image (563), the shooter is expected to hold their fire. An edge position (565) will generally be used as a starting point or rest position, however that is not necessary and the edge position (565) can be used as a decision position itself. This is particularly true when multiple portable rotator devices (900) operate together as part of the training simulation.

In order to provide for a valuable training simulation, as well as a potentially entertaining shooting environment, the portable rotator device (900) will generally be capable of providing the target (56) in either of its image positions for a certain limited period of time. This time can correspond to, for example, the expected amount of time it would take an enemy to raise their own weapon and pull the trigger, or for them to cross a hallway or other visibility point. However, any length of time may be used and the time of presentation may be set by a remote control (201). After the presentation of the particular time has been made, the rotating shaft (101) will rotate the target (56) to a different position. This may be an edge position (565) or another presentation position.

Figure 14:
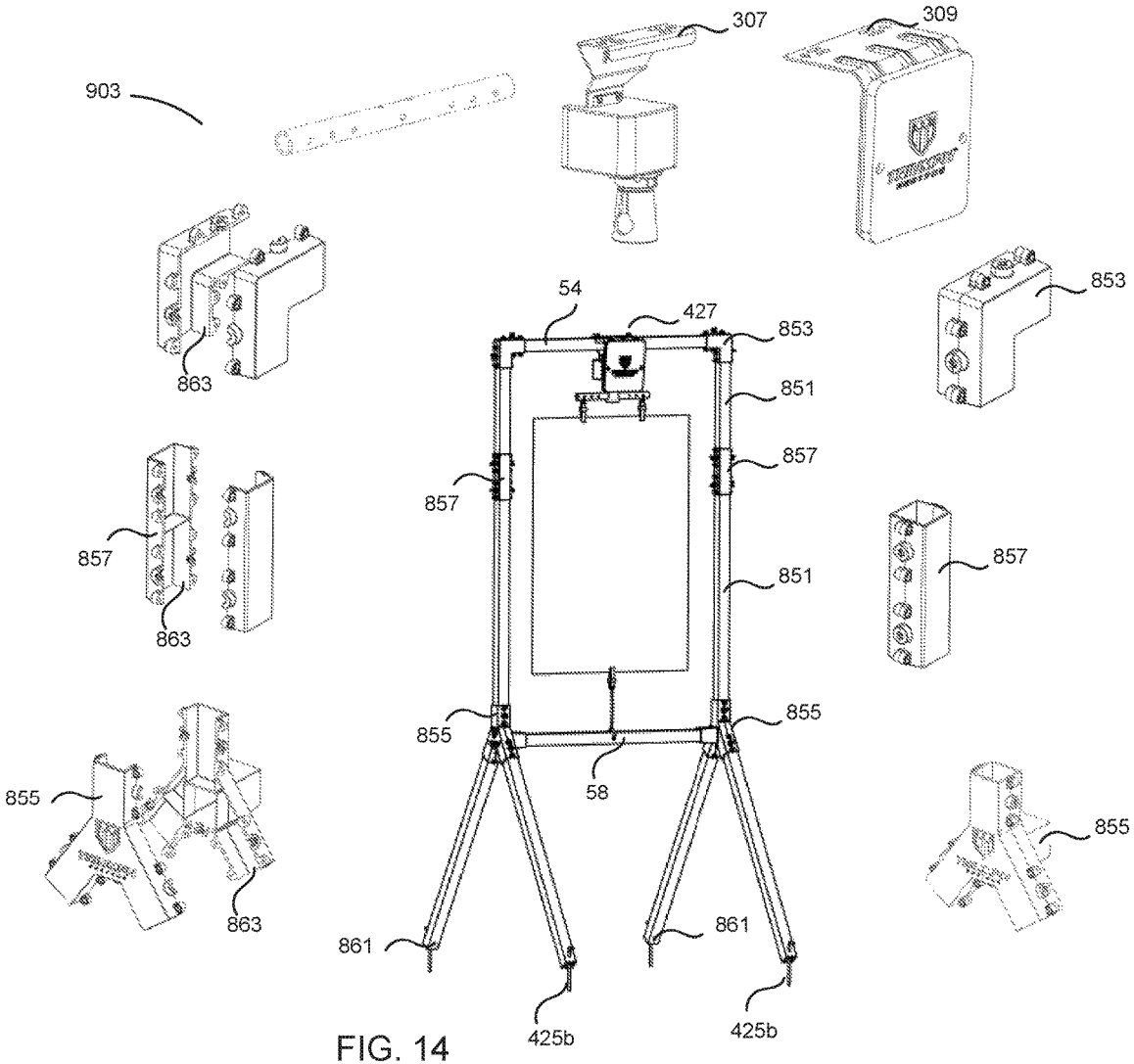
FIG. 14 is an exploded view of the portable rotator and frame of the present invention.

Another aspect of the present invention is a modular support frame for the target (56), having a modular frame (903), a support mounting bracket (307) and a target holder (427) as depicted in FIG. 14. The modular frame (903) is designed to be easily assembled and taken apart for quick use and compact carrying when deconstructed. Thus, the modular frame (903) has an assembled and disassembled configuration. In the assembled configuration, the modular frame (903) has a top cross bar (54) to which a target holder (427) may be attached. In one embodiment, the target holder (427) may be the portable rotator device (900) described herein. In the preferred embodiment, a support mounting bracket (307) connects the target holder (427) to the top cross bar (54) of the modular frame (903). The top cross bar (54) is supported by a pair of side bars (851) attached thereto at opposite ends by a first bracket (853). The first bracket (853) in the preferred embodiment is an L-bracket that connects the side bars (851) and cross bar (54) at a right angle. A bottom cross bar (58) spans the pair of side bars (851) parallel to the top cross bar (54) and creates a frame in which the target (56) may be held. In addition, the bottom cross bar (58) may act as an anchor for the tether (413) described herein. In the preferred embodiment shown in FIG. 14, a second (855) or third bracket (857) connects the pair of side bars (851) and bottom cross bar (58) to a set of base legs (805) that support the entire frame (703). In the preferred embodiment the second bracket (855) is a Y-bracket and the third bracket (857) is a straight-bracket. As the frame (703) itself is designed to be light weight and easily transported, the preferred embodiment also includes friction grips or stakes (425*b*) extending through holes (861) on the bottom of the set of legs (805) that stabilize the entire modular frame (703) when in the assembled configuration.

The brackets of the modular support frame (703) are clam shell style that are held together with standard sized nuts and bolts. These modular brackets facilitate quick setup and takedown along with having easily replaced fasteners should any get lost or damaged. Examples of the clam shell brackets (863) are illustrated in FIG. 14. Further, the clam shell brackets (863) individually connect each section which allows the pairs of sections connected by each shell bracket (863) to be different sizes. For example, the pair of side bars (851) may be completely different dimensions as long as the general length of each side is equal. This may be completed by using a single section on one side and multiple sections connected by one or more straight brackets on the other. Likewise, the top cross bar (54) and bottom cross bar (58) may be different dimensions as the clam shell brackets (863) may be tightened to fit bar sections of many diameters and other dimensions.

In another embodiment, the pair of side bars (851) may be split into one or more sections on each side. These modular side bars (851) allow a user to alter the size of the target frame window as sections may simply be removed if a marksman desires a smaller window or added when a larger window is needed. Further, if a stray projectile hits a portion of the modular frame (703) the damaged section can be easily swapped out and a new section can be inserted. It follows that another aspect of the modular frame (703) is to provide easily interchanged sections that can be quickly replaced. As such, a single section being damaged does not render the entire modular frame (703) unusable. In addition, it is another aspect of the modular frame (703) to be built with readily available and standard sized materials. The modular frame (703) is intended to be light weight in its preferred embodiment and a number of materials may be used including plastic, PVC pipe, and wood. And as the frame (703) is modular and made up of multiple sections, not all sections must be the same material or dimensions to function. For example, if the top cross bar (54) is damaged from a stray bullet, a user need only insert a single piece of replacement material without changing the other sections to match the material or general dimensions of the replacement section.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A portable rotator device for mounting to a support and suspending a target to be rotated, comprising:

a motor suspended from the support, wherein the motor is comprised of a rotating shaft and motor housing having a front face, a back face, a pair of side faces, a mounting side, and a bottom side, wherein the motor is held within the motor housing, wherein the rotating shaft extends through an aperture on the bottom side of the motor housing to a first horizontal plane below the bottom side of the motor housing, and wherein the rotating shaft rotates about a vertical axis;

a pivot mount removably attached to the rotating shaft, and wherein the pivot mount rotates in unison with the rotating shaft when attached thereto;

a support mounting bracket, wherein the support mounting bracket connects the mounting side of the motor housing to the support; and a ballistic shield comprised of a shield mounting bracket, a front face, a back face, a top edge, a pair of side edges, and a bottom edge, wherein the ballistic shield is mounted to at least one of the mounting side of the motor housing and the support mounting bracket by the shield mounting bracket, and wherein the bottom edge of the ballistic shield is at a second horizontal plane below the first horizontal plane.

2. The portable rotator device of claim 1, further comprising a target arm, a tether, and a target clip, wherein the target arm is removably affixed to the pivot mount, wherein the target is removably suspended from the target arm by the target clip, wherein the tether is affixed between a bottom edge of the target and an anchor along the vertical axis, and wherein the anchor is at least one of the group consisting of the support, a weight and a ground stake.

3. The mountable target system of claim 2, wherein the target arm is further comprised of a plurality of apertures, wherein the target clip is removably attached to the target arm through at least one of the plurality of apertures, and wherein a plurality of target clips may be attached thereto.

4. The portable rotator device of claim 1, wherein the rotating shaft has a degree of rotation between 0 and 360 degrees about the vertical axis, and wherein the rotating shaft rotates between the degree of rotation between 20 and 200 milliseconds.

5. The portable rotator device of claim 1, wherein the back face of the ballistic shield is separated from the front face of the motor by a distance.

6. The portable rotator device of claim 5, wherein the front face of the ballistic shield is angled inwardly toward the vertical axis from the top edge to the bottom edge.

7. The portable rotator device of claim 1, wherein the motor is further comprised of a battery, a computer controller, and a remote controller, wherein the battery powers the motor and the computer controller, wherein the remote controller wirelessly communicates with and controls the computer controller, wherein the computer controller communicates with and controls the motor, wherein the motor rotates the rotating shaft about the vertical axis between a plurality of positions, and wherein a first of the plurality of positions presents a front face of the target and a second of the plurality of positions presents at least one of a back face of the target and one of a pair of side edges of the target.

8. The portable rotator device of claim 7, wherein the remote controller is comprised of a rotation randomizer and at least one input control selected from the group consisting of a mode control, a manual rotation control and a time delay control, wherein the rotation randomizer produces a random delay in the rotation of the rotating shaft between the plurality of positions, and wherein the random delay is between 0 and 15 seconds.

9. The portable rotator device of claim 7, wherein the remote controller instructs the computer controller to present the target for at least one of a preset exposure time and a programmable exposure time.

10. The portable rotator device of claim 1, wherein the support mounting bracket is further comprised of a plurality of support mounting apertures and a fastener, wherein at least one mounting aperture mates with the fastener and connects the mounting side of the motor housing to the support, and wherein the fastener is selected from the group consisting of a screw, a hook and loop fastener, a rope, a tape fastener, and a zip tie.

11. A portable rotator device for mounting to a support and suspending a target to be rotated, comprising:

a motor suspended from the support, wherein the motor is comprised of a computer controller, a rotating shaft and motor housing having a front face, a back face, a pair of side faces, a mounting side, and a bottom side, wherein the motor is held within the motor housing, wherein the computer controller communicates with and controls the motor, wherein the rotating shaft extends through an aperture on the bottom side of the motor housing to a first horizontal plane below the bottom side of the motor housing, and wherein the rotating shaft rotates about a vertical axis;

a remote controller having a rotation randomizer wirelessly communicating with and controlling the computer controller;

a pivot mount removably attached to the rotating shaft, and wherein the pivot mount rotates in unison with the rotating shaft when attached thereto;

a support mounting bracket having a plurality of mounting apertures and a fastener, wherein at least one of the mounting apertures mates with the fastener, and wherein the fastener connects the mounting side of the motor housing to the support; and a ballistic shield comprised of a shield mounting bracket, a front face, a back face, a top edge, a pair of side edges, and a bottom edge, wherein the ballistic shield is mounted to the mounting side of the motor housing and to the support mounting bracket by the shield mounting bracket, wherein the bottom edge of the ballistic shield is at a second horizontal plane below the first horizontal plane, and wherein the back face of the ballistic shield is separated from the front face of the motor by a distance.

12. The portable rotator device of claim 11, wherein the motor rotates the rotating shaft about the vertical axis between a plurality of positions, wherein the plurality of positions have a degree of rotation between 0 and 360 degrees about the vertical axis, wherein the rotating shaft rotates between the degree of rotation between 20 and 200 milliseconds, wherein the rotation randomizer produces a random delay in the rotation of the rotating shaft between the plurality of positions, wherein the random delay is between 0 and 15 seconds, and wherein the remote controller is further comprised of at least one input control selected from the group consisting of a mode control, a manual rotation control and a time delay control.

13. The portable rotator device of claim 11, wherein the motor is further comprised of a battery, wherein the battery powers the motor and the computer controller, and wherein a first of the plurality of positions presents a front face of the target and a second of the plurality of positions presents at least one of a back face of the target and one of a pair of side edges of the target.

14. The portable rotator device of claim 11, wherein the fastener is selected from the group consisting of a screw, a hook and loop fastener, a rope, a tape fastener, and a zip tie.

15. The portable rotator device of claim 11, further comprising a target arm, a tether, and a target clip, wherein the target arm is removably affixed to the pivot mount, wherein the target is removably suspended from the target arm by the target clip, wherein the tether is affixed between a bottom edge of the target and a bottom cross bar along the vertical axis of the rotating shaft.

16. A modular support for a target, comprising:

a modular frame having a top cross bar, a bottom cross bar, a pair of side bars, and a base, wherein the top cross bar is supported by the pair of side bars and attached thereto by a first bracket, wherein the pair of side bars are supported by the bottom cross bar and are attached thereto by a second bracket, and wherein the base is attached to at least one of the pair of side bars and the bottom cross bar by at least one of the second bracket and a third bracket;

a support mounting bracket;

a motor comprised of a rotating shaft and motor housing having a front face, a back face, a pair of side faces, a mounting side, and a bottom side, wherein the support mounting bracket connects the mounting side of the motor housing to the top cross bar, wherein the motor is held within the motor housing, wherein the rotating shaft extends through an aperture on the bottom side of the motor housing to a first horizontal plane below the bottom side of the motor housing, and wherein the rotating shaft rotates about a vertical axis;

a pivot mount removably attached to the rotating shaft, and wherein the pivot mount rotates in unison with the rotating shaft when attached thereto;

a ballistic shield comprised of a shield mounting bracket, a front face, a back face, a top edge, a pair of side edges, and a bottom edge, wherein the ballistic shield is mounted to at least one of the mounting side of the motor housing and the support mounting bracket by the shield mounting bracket, and wherein the bottom edge of the ballistic shield is at a second horizontal plane below the first horizontal plane; and a target holder suspended from the top cross bar of the modular frame, wherein the target is removably suspended from the target holder.

17. The mountable target system of claim 16, wherein the target holder is comprised of a target arm, a tether, and a target clip, wherein the target arm is removably affixed to the pivot mount, wherein the target is removably suspended from the target arm by the target clip, and wherein the tether is affixed between a bottom edge of the target and bottom cross bar along the vertical axis of the rotating shaft.

18. The mountable target system of claim 16, wherein the pair of side bars are further comprised of a first bar and a second bar, wherein the first bar and the second bar are connected by a straight-bracket, wherein the first bracket and the third bracket are comprised of an L-bracket, and wherein the second bracket is comprised of a Y-bracket.

19. The mountable target system of claim 16, wherein the modular frame has a collapsed configuration and an assembled configuration, wherein the collapsed configuration is compacted, wherein the assembled configuration is extended to form a main opening, and wherein the target holder is suspended within the main opening in the assembled configuration.

20. The mountable target system of claim 16, wherein the support mounting bracket is comprised of a plurality of support mounting apertures and a fastener, wherein at least one mounting apertures mates with the fastener and connects the mounting side of the motor housing to the top cross bar, and wherein the fastener is selected from the group consisting of a screw, a hook and loop fastener, a rope, a tape fastener, and a zip tie.

* * * * *